US008546300B2

(12) United States Patent
Uchimura

(10) Patent No.: US 8,546,300 B2
(45) Date of Patent: Oct. 1, 2013

(54) THERMOSENSITIVE RECORDING MATERIAL AND IMAGE RECORDING METHOD

(75) Inventor: Kazuhiro Uchimura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 192 days.

(21) Appl. No.: 13/004,226

(22) Filed: Jan. 11, 2011

(65) Prior Publication Data

US 2011/0177941 A1 Jul. 21, 2011

(30) Foreign Application Priority Data

Jan. 15, 2010 (JP) ..... 2010-007392
Feb. 12, 2010 (JP) ..... 2010-029224

(51) Int. Cl.
*B41M 5/42* (2006.01)

(52) U.S. Cl.
USPC ..... 503/226; 503/207

(58) Field of Classification Search
None
See application file for complete search history.

(56) References Cited

U.S. PATENT DOCUMENTS

2008/0096762 A1 4/2008 Takano et al.

FOREIGN PATENT DOCUMENTS

| | | |
|---|---|---|
| CN | 1373047 | 10/2002 |
| CN | 101386237 | 3/2009 |
| JP | 62-184880 | 8/1987 |
| JP | 6-48038 | 2/1994 |
| JP | 8-282114 | 10/1996 |
| JP | 10-44609 | 2/1998 |
| JP | 10-235996 | 9/1998 |
| JP | 10-264529 | 10/1998 |
| JP | 10-278428 | 10/1998 |
| JP | 2936556 | 6/1999 |
| JP | 3156401 | 2/2001 |
| JP | 3446092 | 7/2003 |
| JP | 3463080 | 8/2003 |
| JP | 3635388 | 1/2005 |
| JP | 3829426 | 7/2006 |
| JP | 2008-68580 | 3/2008 |
| JP | 4184017 | 9/2008 |
| JP | 2009-262563 | 11/2009 |

OTHER PUBLICATIONS

Mar. 9, 2011 European search report in connection with counterpart European patent application No. 11 25 0041.
Chinese official action dated Mar. 21, 2013 and translation in corresponding Chinese patent application No. 2011 10 02 1891.5.

*Primary Examiner* — Bruce H Hess
(74) *Attorney, Agent, or Firm* — Cooper & Dunham LLP

(57) ABSTRACT

A thermosensitive recording material including: a support; an undercoat layer containing at least a water-soluble resin; a thermosensitive coloring layer containing a leuco dye and a developer; and a protective layer containing a water-soluble resin and a fluorescent whitening agent, wherein the undercoat layer, the thermosensitive coloring layer, and the protective layer are formed in this order over the support, wherein the undercoat layer has a single layer structure or a multilayer structure, and the protective layer has a single layer structure or a multilayer structure, and wherein the undercoat layer has an air permeance of 150 mL/min or less.

14 Claims, 2 Drawing Sheets

THERMOSENSITIVE RECORDING MATERIAL AND IMAGE RECORDING METHOD

BACKGROUND OF THE INVENTION

1. Field of the Invention

The present invention relates to a thermosensitive recording material, in which a protective layer containing a fluorescent whitening agent is formed on a thermosensitive coloring layer, and an image recording method using the thermosensitive recording material.

2. Description of the Related Art

Thermosensitive recording materials are used in various fields: POS field such as perishable foods, boxed meals, and prepared food; copying field such as books and documents; communication field such as facsimile; ticketing field such as ticket vending machines and receipts; and aviation industry such as baggage tags. As the thermosensitive recording materials are widely used, improvement of whiteness, light resistance, and water resistance have been increasingly demanded.

As such thermosensitive recording material, conventionally known thermosensitive recording materials are those having a protective layer containing a fluorescent whitening agent provided on a thermosensitive coloring layer for improving whiteness.

For example, proposed is a thermosensitive recording material having a protective layer which contains 0.1 parts by mass to 10 parts by mass of a fluorescent whitening agent (see Japanese Patent Application Laid-Open (JP-A) No. 62-184880). Moreover, a thermosensitive recording material having a protective layer, which contains a cationic fluorescent naphthalimide dye, has been proposed (Japanese Patent (JP-B) No. 3446092).

However, in these proposals, since the small amount of the fluorescent whitening agent is contained in the protective layer, effect on improvement of whiteness in appearance is confirmed, but light resistance is not sufficiently attained.

It has been known that the light resistance is improved by adding the fluorescent whitening agent. For example, there has been proposed a thermosensitive recording material in which a stilbene fluorescent dye is contained in a dry mass of 0.1 $g/m^2$ to 0.5 $g/m^2$ in a protective layer, which is provided on a thermosensitive coloring layer (JP-B No. 3463080).

According to this proposal, the light resistance is improved to a certain degree, but sufficient light resistance has not been achieved. Namely, such problem is pointed out that when the amount of the fluorescent whitening agent (fluorescent dye) is increased to achieve sufficient light resistance, background is turned into yellow color. In the composition of this proposal, it is difficult to increase the amount of the fluorescent whitening agent more than the aforementioned range.

Similar to this proposal, there has been proposed a method of adding a fluorescent whitening agent to a protective layer (see JP-A No. 10-44609) so as to improve the light resistance. However, there is also a problem that sufficient light resistance cannot be achieved.

On the other hand, there is a proposal of a method of attaining the light resistance by adding a fluorescent whitening agent to a protective layer of a thermosensitive recording material that uses near-infrared absorption material as a coloring material (see JP-A No. 3156401). Here, it has been disclosed an Example that the sufficient light resistance is attained in a thermosensitive recording material, in which a protective layer is formed by using a protective layer dispersion liquid, which is prepared by adding 40 parts by mass of a 50% fluorescent dye aqueous solution to 100 parts by mass of a dispersion liquid.

With this amount of the fluorescent whitening agent in the Example, the light resistance is improved in the image part, but the color of the background is changed into yellow as described in JP-B No. 3463080, and satisfiable background whiteness cannot be obtained.

Moreover, in the thermosensitive recording material in which near-infrared absorption material is used as a coloring material, another method of containing the fluorescent whitening agent in the protective layer has been proposed (JP-A No. 06-48038). In this proposal, a main effect is to improve the whiteness in appearance, and the improvement of the light resistance is not achieved.

Therefore, in these proposals, it is difficult to achieve both the light resistance and the background whiteness.

Moreover, when the certain amount of the fluorescent whitening agent is intended to be provided in the resulting recording material by increasing the deposition amount of the protective layer while the amount of the fluorescent whitening agent is kept low in the protective layer dispersing solution, it is necessary to considerably increase the deposition amount of the protective layer. There is a problem of causing decrease in coloring properties in a thermosensitive coloring layer.

In light of these problems, there has been proposed a method of attaining both the light resistance and the background whiteness by using an ultraviolet absorbing agent in combination with the fluorescent whitening agent so as to decrease the amount of the fluorescent whitening agent (see JP-B Nos. 3829426, 3635388 and 2936556, and JP-A Nos. 10-235996 and 08-282114).

However, in the case where the ultraviolet absorbing agent is contained in a thermosensitive coloring layer, storage stability such as heat resistance and coloring properties decrease, and in the case where the ultraviolet absorbing agent is contained in a protective layer, sticking and poor head matching properties such as contaminant adhesion to a head occur.

The mechanism of deterioration by light is not exactly known. However, it is experimentally confirmed that when the thermosensitive coloring layer is exposed to light such as sunlight in the state that oxygen ingresses in the thermosensitive coloring layer, a leuco dye contained in the thermosensitive coloring layer is degraded by reaction with the oxygen and ultraviolet light contained in the sunlight etc., causing change of color in the background of the thermosensitive recording material and color fading of images thereon.

To drastically improve the light resistance, it is important to block not only the ultraviolet light, but also the oxygen. Particularly, oxygen ingresses not only from the upper side of the thermosensitive coloring layer (i.e. the side exposed to light such as sunlight, etc.), but also from the lower side of the thermosensitive coloring layer. Thus, it is necessary to block oxygen which ingresses from the lower side of the thermosensitive coloring layer as well as from the upper side thereof.

In this point, in prior art, a protective layer is provided on the thermosensitive coloring layer so as to block the oxygen ingression from the upper side, but blocking of the oxygen ingression from the lower side has not been studied. Namely, an undercoat layer is conventionally provided for the purpose of improvement of coloring sensitivity and fineness of printed images. Accordingly, the undercoat layer is designed to have a function of enhancing porosity inside the layer, and of improving adhesion properties and thermal insulation properties of the thermosensitive recording material.

Since the above-mentioned function is inhibited by adding a large amount of a resin in the undercoat layer, only the minimum amount of the resin is used to impart binding properties between layers. As a result, the conventionally used undercoat layer has low ability of blocking oxygen, and satisfiable light resistance cannot be obtained.

For example, in JP-B Nos. 3829426 and 3635388, and JP-A No. 10-235996, there has been proposed to provide an under layer (undercoat layer). Each of these undercoat layers enhances coloring sensitivity and has a function of blocking ultraviolet light. However, as described above, the undercoat layer is designed to increase hollow with decreasing the amount of the resin so as to enhance the coloring sensitivity, causing high air permeance. Consequently, the undercoat layer has low ability of blocking oxygen, and satisfiable light resistance cannot be attained.

Therefore, at the moment, there is no satisfiable thermosensitive recording material having excellent light resistance and water resistance, and high whiteness.

BRIEF SUMMARY OF THE INVENTION

An object of the present invention is to provide a thermosensitive recording material having excellent light resistance, water resistance, and high whiteness, and an image recording method using the thermosensitive recording material.

Means for solving the aforementioned problems are as follows.

<1> A thermosensitive recording material including: a support; an undercoat layer containing at least a water-soluble resin; a thermosensitive coloring layer containing a leuco dye and a developer; and a protective layer containing a water-soluble resin and a fluorescent whitening agent, wherein the undercoat layer, the thermosensitive coloring layer and the protective layer are formed in this order over the support, wherein the undercoat layer has a single layer structure or a multilayer structure, and the protective layer has a single layer structure or a multilayer structure, and wherein the undercoat layer has an air permeance of 150 mL/min or less.

<2> The thermosensitive recording material according to <1>, wherein the undercoat layer further contains hollow particles.

<3> The thermosensitive recording material according to <2>, wherein the amount of the water-soluble resin in the undercoat layer is 50% by mass to 80% by mass relative to the total amount of the hollow particles and the water-soluble resin.

<4> The thermosensitive recording material according to <1>, wherein the undercoat layer contains a first undercoat layer containing the water-soluble resin and a second undercoat layer containing hollow particles, and the second undercoat layer and the first undercoat layer are formed in this order over the support toward the thermosensitive coloring layer.

<5> The thermosensitive recording material according to any of <1> to <4>, wherein the protective layer contains a first protective layer containing the water-soluble resin and the fluorescent whitening agent and a second protective layer containing a water-soluble resin but no fluorescent whitening agent, and wherein the first protective layer and the second protective layer are formed in this order over the thermosensitive coloring layer.

<6> The thermosensitive recording material according to any of <1> to <5>, wherein the fluorescent whitening agent is a stilbene compound.

<7> The thermosensitive recording material according to any of <5> and <6>, wherein the dry mass of the fluorescent whitening agent in the first protective layer is 0.5 g/m$^2$ to 1.5 g/m$^2$, and the amount of the fluorescent whitening agent in the first protective layer is 20% by mass or more relative to the total amount of the first protective layer, and the amount of the fluorescent whitening agent is 55% by mass or less relative to the total amount of the fluorescent whitening agent in the first protective layer and the water-soluble resins in the first protective layer and the second protective layer.

<8> The thermosensitive recording material according to any of <5> to <7>, wherein the first protective layer further contains a crosslinking agent.

<9> The thermosensitive recording material according to any of <5> to <8>, wherein the second protective layer further contains a crosslinking agent, an inorganic filler, and a lubricant.

<10> A thermosensitive recording material including: a thermosensitive coloring layer; a first protective layer containing a fluorescent whitening agent and a water-soluble resin; and a second protective layer containing a water-soluble resin but no fluorescent whitening agent, wherein the first protective layer and the second protective layer are formed in this order over the thermosensitive coloring layer, and wherein the dry mass of the fluorescent whitening agent in the first protective layer is 0.5 g/m$^2$ to 1.5 g/m$^2$, and the amount of the fluorescent whitening agent in the first protective layer is 20% by mass or more relative to the total amount of the first protective layer, and the amount of the fluorescent whitening agent is 55% by mass or less relative to the total amount of the fluorescent whitening agent in the first protective layer and the water-soluble resins in the first protective layer and the second protective layer.

<11> The thermosensitive recording material according to <10>, wherein the fluorescent whitening agent is a stilbene compound.

<12> The thermosensitive recording material according to any of <10> and <11>, wherein the first protective layer further contains a crosslinking agent.

<13> The thermosensitive recording material according to any of <10> to <12>, wherein the second protective layer further contains a crosslinking agent, an inorganic filler, and a lubricant.

<14> An image forming method including recording an image on the thermosensitive recording material according to any of <1> to <13> using an image recording unit, which is any one of a thermal head and a laser.

<15> The image recording method according to <14>, wherein the laser is a $CO_2$ laser which emits light having a wavelength of 9.3 μm to 10.6 μm.

Accordingly, the present invention can solve the conventional problems, and achieves the object, and thus provides a thermosensitive recording material having excellent light resistance, water resistance, and high whiteness, and an image recording method using the thermosensitive recording material.

DETAILED DESCRIPTION OF THE INVENTION

First Embodiment of Thermosensitive Recording Material

Figure 1:
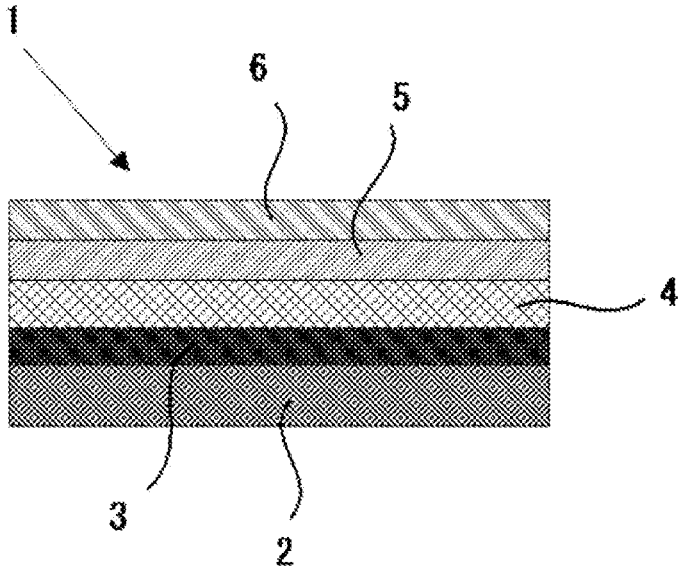
FIG. 1 shows a schematic cross sectional view showing an example of a layer structure of a thermosensitive recording material of the first embodiment of the present invention.

A thermosensitive recording material of the first embodiment of the present invention includes a support, at least one undercoat layer, a thermosensitive coloring layer and at least one protective layer, wherein the undercoat layer, the thermosensitive coloring layer and the protective layer are formed in this order over the support, and if necessary further includes other layers.

<Support>

The support is suitably selected depending on the intended purpose without any restriction. As the support, any of supports made of woodfree paper, recycled pulp (containing 50% or more of recycled pulp), synthetic paper, polyethylene films, and laminated paper, etc. may be used.

<Undercoat Layer>

The undercoat layer has an air permeance of 150 mL/min or less.

When the air permeance is more than 150 mL/min, the performance of the undercoat layer required for light resistance, i.e. performance for blocking the oxygen ingression from a surface of the undercoat layer facing the support, is insufficient, and a desired light resistance cannot be attained.

From this standpoint, the air permeance of the undercoat layer is more preferably 50 mL/min or less, ideally 0 mL/min.

Here, the air permeance can be measured using BENDTSEN TESTER (manufactured by Messmer Instruments Ltd.) in accordance with ISO5636 (Bendtsen method).

The undercoat layer is suitably selected depending on the intended purpose without any restriction. The undercoat layer may be a single layer or formed of two or more layers.

Namely, in the case where a layer which is adjacent to the thermosensitive coloring layer and contains the water-soluble resin is defined as a first undercoat layer, the undercoat layer may be formed of the first undercoat layer itself, and if necessary the undercoat layer may be a laminate in which a second undercoat layer and a third undercoat layer are formed over the surface of the first undercoat layer, which surface faces the support.

—First Undercoat Layer—

The first undercoat layer is adjacent to the thermosensitive coloring layer and contains the water-soluble resin, and the undercoat layer may be formed of the first undercoat layer itself.

The water-soluble resin is suitably selected depending on the intended purpose without any restriction. Examples thereof include polyvinyl alcohol, modified polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, modified polyacrylamide, methyl vinyl ether-maleic anhydride copolymers, carboxyl-modified polyethylene, polyvinyl alcohol-acryl amide block copolymers, melamine-formaldehyde resin, urea-formaldehyde resin, alginate soda, gelatin and casein. These may be used alone or in combination. Among these, polyvinyl alcohol is particularly preferable.

The first undercoat layer is formed by applying a water dispersion of the water-soluble resin and followed by drying. As the components added to the water dispersion and contained in the first undercoat layer, an inorganic filler, hollow particles, and a aqueous emulsion resin, and further other components may be used. Particularly, when an image is formed by using a thermal head, hollow particles are preferably used in order to improve the coloring sensitivity and fineness.

The amount of the water-soluble resin in the first undercoat layer is suitably selected depending on the intended purpose without any restriction. It is preferably 20% by mass to 80% by mass, more preferably 30% by mass to 70% by mass.

When the amount of the water-soluble resin in the first undercoat layer is less than 20% by mass, it is difficult to obtain a predetermined air permeance. When it is more than 80% by mass, in the case where an image is formed using a thermal head, sufficient coloring sensitivity may not be easily obtained.

The inorganic filler is suitably selected depending on the intended purpose without any restriction. Examples thereof include aluminum hydroxide, calcium carbonate, aluminum oxide, zinc oxide, titanium dioxide, silica, barium sulfate, talc, kaolin, alumina and clay. These may be used alone or in combination. Among these, aluminum hydroxide, calcium carbonate, kaolin and clay are preferable in terms of liquid properties in a coating liquid, stability of dispersed particles, and water solubility.

The hollow particles preferably have a hollow ratio of 80% or more, more preferably 90% or more. When the hollow ratio is less than 80%, thermal insulating properties and cushioning properties are insufficient. In the case where image formation is performed using a thermal head, heat energy from the thermal head is emitted to the outside of the thermosensitive recording material via the support, and the adhesion properties between the thermal head and the thermosensitive recording material becomes poor, causing less effect on improving sensitivity and fineness. The practically obtainable hollow particles each have a hollow ratio of 98% or less.

The hollow ratio referred to herein is expressed by the following equation:

$$\text{Hollow ratio (\%)} = (\text{inner diameter of a hollow particle} / \text{outer diameter of the hollow particle}) \times 100$$

Each of the hollow particles has a shell made of a thermoplastic resin and contains therein air or other gas. They are fine hollow particles already in a foamed state, and those having a volume average particle diameter of 2 μm to 10 μm are preferably used.

When the volume average particle diameter (outer particle diameter) is less than 2 μm, there is a production problem of difficulty in obtaining given hollow ratio. When the volume average particle diameter is more than 10 μm, the smoothness of the dried coated surface decreases, causing decrease in adhesion properties between the thermal head and the thermosensitive recording material, and less effect on improving sensitivity. Accordingly, the hollow particles preferably have a sharp distribution peak with little variation as well as a volume average particle diameter falling within the aforementioned range.

The hollow particles are particles each having a thermoplastic resin as a shell, and examples of the thermoplastic resin include polystyrene, polyvinyl chloride, polyvinylidene chloride, polyvinyl acetate, polyacrylic ester, polyacrylonitrile, and polybutadiene, and copolymer resins thereof.

Among these, the copolymer resins which contain vinylidene chloride and acrylonitrile as main constituents are particularly preferable.

The aqueous emulsion resin is suitably selected depending on the intended purpose without any restriction. Examples thereof include: latexes of, for example, styrene-butadiene copolymers, and styrene-butadiene-acryl copolymers; and emulsions of, for example, vinyl acetate resins, vinyl acetate-acrylate copolymers, styrene-acrylate copolymers, acrylate resins, and polyurethane resins. These may be used alone or in combination.

The amount of the hollow particles after dried is preferably 0.2 g or more, more preferably 0.4 g to 5 g, per square meter of the support.

The amount of the water-soluble resin is preferably 60% by mass to 80% by mass, relative to the total amount of the hollow particles and the water-soluble resin. The amount of the water-soluble resin is less than 60% by mass, it is difficult to obtain a predetermined air permeance. When it is more than 80% by mass, the sufficient coloring sensitivity is not easily obtained.

The deposition amount of the first undercoat layer in the thermosensitive recording material is suitably selected depending on the intended purpose without any restriction. It is preferably 0.4 $g/m^2$ to 10 $g/m^2$, more preferably 0.6 $g/m^2$ to 7 $g/m^2$.

When the deposition amount of the first undercoat layer is less than 0.4 $g/m^2$, it is difficult to obtain a predetermined air permeance. When the deposition amount is more than 10 $g/m^2$, the binding properties of the first undercoat layer may decrease.

—Second Undercoat Layer—

The undercoat layer is suitably selected depending on the intended purpose without any restriction, as long as the undercoat layer includes the first undercoat layer. In order to improve the coloring sensitivity of the thermosensitive coloring layer, a second undercoat layer contains hollow particles may be formed on a surface of the first undercoat layer, which surface faces the support.

The second undercoat layer contains hollow particles and a binder, and may further contain other components as necessary.

The hollow particles preferably have a hollow ratio of 80% or more, more preferably 90% or more. When the hollow ratio is less than 80%, thermal insulating properties and cushioning properties are insufficient. In the case where image formation is performed using a thermal head, heat energy from the thermal head is emitted to the outside of the thermosensitive recording material via the support, and the adhesion properties between the thermal head and the thermosensitive recording material becomes poor, causing less effect on improving sensitivity and fineness. The practically obtainable hollow particles each have a hollow ratio of 98% or less.

The hollow ratio referred to herein is expressed by the following equation, in the same manner as the hollow ratio of the first undercoat layer:

$$\text{Hollow ratio (\%)} = (\text{inner diameter of a hollow particle} / \text{outer diameter of the hollow particle}) \times 100$$

Each of the hollow particles has a shell made of a thermoplastic resin and contains therein air or other gas. They are fine hollow particles already in a foamed state, and those having a volume average particle diameter of 2 μm to 10 μm are preferably used.

When the volume average particle diameter (outer particle diameter) is less than 2 μm, there is a production problem of difficulty in obtaining given hollow ratio. When the volume average particle diameter is more than 10 μm, the smoothness of the dried coated surface decreases, causing decrease in the adhesion properties between the thermal head and the thermosensitive recording material, and less effect on improving sensitivity. Accordingly, the hollow particles preferably have a sharp distribution peak with little variation as well as a volume average particle diameter falling within the aforementioned range.

The hollow particles are particles each having a thermoplastic resin as a shell, and examples of the thermoplastic resin include polystyrene, polyvinyl chloride, polyvinylidene chloride, polyvinyl acetate, polyacrylic ester, polyacrylonitrile, and polybutadiene, and copolymer resins thereof. Among these, the copolymer resins which contain vinylidene chloride and acrylonitrile as main constituents are particularly preferable.

The binder is suitably selected from at least any one of conventionally known water-soluble polymers and conventionally known aqueous polymer emulsions depending on the intended purpose without any restriction.

Examples of the water-soluble polymers include polyvinyl alcohol, starch and derivatives thereof, cellulose derivatives such as methoxy cellulose, hydroxy ethyl cellulose, carboxy methyl cellulose, methyl cellulose and ethyl cellulose; polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, alginate soda, gelatin and casein.

Examples of the aqueous polymer emulsions include latexes of, for example, styrene-butadiene copolymers and styrene-butadiene-acryl copolymers; and emulsions of, for example, a vinyl acetate resin, vinyl acetate-acrylate copolymers, styrene-acrylate copolymers, acrylate resins and polyurethane resins. These may be used alone or in combination.

The second undercoat layer is formed by dispersing the hollow particles and the binder in water, followed by applying the resultant liquid, and then drying.

In this case, the amount of the hollow particles after dried is preferably 0.2 g or more, more preferably 0.4 g to 5 g, per square meter of the support.

The coating amount of the binder is an amount sufficient enough to strongly bind the second undercoat layer with a layer adjacent thereto, and preferably 2% by mass to 50% by mass relative to the total amount of the hollow particles and the binder.

<Thermosensitive Coloring Layer>

The thermosensitive coloring layer contains a leuco dye and a developer, and further contains other components as necessary.

—Leuco Dye—

The leuco dye is a compound exhibiting electron donation properties, and may be used singly or in combination of two or more species. However, the leuco dye itself is a colorless or light-colored dye precursor, and commonly known leuco compounds can be used. Examples of the leuco compounds include triphenylmethane phthalide compounds, triarylmethane compounds, fluoran compounds, phenothiazine compounds, thiofluoran compounds, xanthen compounds, indophthalyl compounds, spiropyran compounds, azaphthalide compounds, chlormenopirazole compounds, methyne compounds, rhodamine anilinolactum compounds, rhodamine lactum compounds, quinazoline compounds, diazaxanthen compounds, bislactone compounds. In consideration of coloring property, fogging of the background, and color fading of the image due to moisture, heat or light radiation, specific examples of such compounds are as follows. 2-anilino-3-methyl-6-diethyl amino fluoran, 2-anilino-3-methyl-6-(di-n-butyl amino)fluoran, 2-anilino-3-methyl-6-(di-n-pentyl amino)fluoran, 2-anilino-3-methyl-6-(N-n-propyl-N-methyl amino)fluoran, 2-anilino-3-methyl-6-(N-isopropyl-N-methyl amino)fluoran, 2-anilino-3-methyl-6-(N-isobutyl-N-methyl amino)fluoran, 2-anilino-3-methyl-6-(N-n-amyl-N-methyl amino)fluoran, 2-anilino-3-methyl-6-(N-sec-butyl-N-ethyl amino)fluoran, 2-anilino-3-methyl-6-(N-n-amyl-N-ethyl amino)fluoran, 2-anilino-3-methyl-6-(N-iso-amyl-N-ethyl amino)fluoran, 2-anilino-3-methyl-6-(N-cyclohexyl-N-methyl amino)fluoran, 2-anilino-3-methyl-6-(N-ethyl-p-toluidino)fluoran, 2-anilino-3-methyl-6-(N-methyl-p-toluidino)fluoran, 2-(m-trichloro methyl anilino)-3-methyl-6-diethyl amino fluoran, 2-(m-trifluoro methyl anilino)-3-methyl-6-diethyl amino fluoran, 2-(m-trifluoro methyl anilino)-3-methyl-6-(N-cyclohexyl-N-methyl amino)fluoran, 2-(2,4-dimethyl anilino)-3-methyl-6-diethyl amino fluoran, 2-(N-ethyl-p-toluidino)-3-methyl-6-(N-ethyl anilino)fluoran, 2-(N-methyl-p-toluidino)-3-methyl-6-(N-propyl-p-toluidino)fluoran, 2-anilino-6-(N-n-hexyl-N-ethyl amino)fluoran, 2-(o-chloranilino)-6-diethyl amino fluoran, 2-(o-bromoanilino)-6-diethyl amino fluoran, 2-(o-chloranilino)-6-dibutyl amino fluoran, 2-(o-fluoroanilino)-6-dibutyl amino fluoran, 2-(m-trifluoro methyl anilino)-6-diethylamino fluoran, 2-(p-acetyl anilino)-6-(N-n-amyl-N-n-butyl amino)fluoran, 2-benzyl amino-6-(N-ethyl-p-toluidino)fluoran, 2-benzyl amino-6-(N-methyl-2,4-dimethyl anilino)fluoran, 2-benzyl amino-6-(N-ethyl-2,4-dimethyl anilino)fluoran, 2-dibenzyl amino-6-(N-methyl-p-toluidino)fluoran, 2-dibenzyl amino-6-(N-ethyl-p-toluidino) fluoran, 2-(di-p-methyl benzyl amino)-6-(N-ethyl-p-toluidino)fluoran, 2-(α-phenyl ethyl amino)-6-(N-ethyl-p-toluidino)fluoran, 2-methyl amino-6-(N-methyl anilino) fluoran, 2-methyl amino-6-(N-ethyl anilino)fluoran, 2-methyl amino-6-(N-propyl anilino)fluoran, 2-ethyl amino-6-(N-methyl-p-toluidino)fluoran, 2-methyl amino-6-(N-methyl-2,4-dimethyl anilino)fluoran, 2-ethyl amino-6-(N-methyl-2,4-dimethyl anilino)fluoran, 2-dimethyl amino-6-(N-methyl anilino)fluoran, 2-dimethyl amino-6-(N-ethyl anilino)fluoran, 2-diethyl amino-6-(N-methyl-p-toluidino) fluoran, benzo leuco methylene blue, 2-[3,6-bis(diethyl amino)]-6-(o-chloranilino)xanthyl benzoic acid lactum, 2-[3,6-bis(diethyl amino)]-9-(o-chloranilino)xanthyl benzoic acid lactum, 3,3-bis(p-dimethyl amino phenyl)phthalide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorophthalide, 3,3-bis(p-dibutyl amino phenyl)phthalide, 3-(2-methoxy-4-dimethyl amino phenyl)-3-(2-hydroxy-4,5-dichlorophenyl)phthalide, 3-(2-hydroxy-4-dimethyl amino phenyl)-3-(2-methoxy-5-chlorophenyl)phthalide, 3-(2-hydroxy-4-dimethoxy amino phenyl)-3-(2-methoxy-5-chlorophenyl) phthalide, 3-(2-hydroxy-4-dimethoxy amino phenyl)-3-(2-methoxy-5-nitrophenyl)phthalide, 3-(2-hydroxy-4-diethyl amino phenyl)-3-(2-methoxy-5-methyl phenyl)phthalide, 3,6-bis(dimethyl amino)fluorenespiro(9,3')-6'-dimethyl amino phthalide, 6'-chloro-8'-methoxy-benzoindolino spiropyran, and 6'-bromo-2'-methoxy benzoindolino spiropyran. These may be used alone or in combination.

The amount of the leuco dye contained in the thermosensitive coloring layer is preferably 5% by mass to 20% by mass, more preferably 10% by mass to 15% by mass.

—Developer—

As the developer, various electron accepting materials are suitably used to react with the aforementioned leuco dye at the time of heating so as to develop colors. Examples thereof include phenolic compounds, organic or inorganic acidic compounds and esters or salts thereof.

Specific examples thereof include bisphenol A, tetrabromobisphenol A, gallic acid, salicylic acid, 3-isopropyl salicylate, 3-cyclohexyl salicylate, 3-5-di-tert-butyl salicylate, 3,5-di-α-methyl benzyl salicylate, 4,4'-isopropylidenediphenol, 1,1'-isopropylidene bis(2-chlorophenol), 4,4'-isopropylidene bis(2,6-dibromophenol), 4,4'-isopropylidene bis(2,6-dichlorophenol), 4,4'-isopropylidene bis(2-methyl phenol), 4,4'-isopropylidene bis(2,6-dimethyl phenol), 4,4'-isopropylidene bis(2-tert-butyl phenol), 4,4'-sec-butylidene diphenol, 4,4'-cyclohexylidene bisphenol, 4,4'-cyclohexylidene bis(2-methyl phenol), 4-tert-butyl phenol, 4-phenyl phenol, 4-hydroxy diphenoxide, α-naphthol, β-naphthol, 3,5-xylenol, thymol, methyl-4-hydroxybenzoate, 4-hydroxyacetophenone, novolak phenol resins, 2,2'-thio bis(4,6-dichloro phenol), catechol, resorcin, hydroquinone, pyrogallol, fluoroglycine, fluoroglycine carboxylate, 4-tert-octyl catechol, 2,2'-methylene bis(4-chlorophenol), 2,2'-methylene bis(4-methyl-6-tert-butyl phenol), 2,2'-dihydroxy diphenyl, ethyl p-hydroxybenzoate, propyl p-hydroxybenzoate, butyl p-hydroxybenzoate, benzyl p-hydroxybenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphthoic acid, 2-hydroxy-6-naphthoic acid, 2-hydroxy-6-zinc naphthoate, 4-hydroxy diphenyl sulphone, 4-hydroxy-4'-chloro diphenyl sulfone, bis(4-hydroxy phenyl)sulfide, 2-hydroxy-p-toluic acid, 3,5-di-tert-zinc butyl salicylate, 3,5-di-tert-tin butyl salicylate, tartaric acid, oxalic acid, maleic acid, citric acid, succinic acid, stearic acid, 4-hydroxyphthalic acid, boric acid, thiourea derivatives, 4-hydroxy thiophenol derivatives, bis(4-hydroxyphenyl)acetate, bis(4-hydroxyphenyl) ethyl acetate, bis(4-hydroxyphenyl)acetate-n-propyl, bis(4-hydroxyphenyl)acetate-n-butyl, bis(4-hydroxyphenyl) phenyl acetate, bis(4-hydroxyphenyl)benzyl acetate, bis(4-hydroxyphenyl)phenethyl acetate, bis(3-methyl-4-hydroxyphenyl)acetate, bis(3-methyl-4-hydroxyphenyl) methyl acetate, bis(3-methyl-4-hydroxyphenyl)acetate-n-propyl, 1,7-bis(4-hydroxyphenylthio) 3,5-dioxaheptane, 1,5-bis(4-hydroxyphenylthio)3-oxaheptane, 4-hydroxy phthalate dimethyl, 4-hydroxy-4'-methoxy diphenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isopropoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzoxy)diphenyl sulfone, 4-hydroxy-4'-(p-methyl benzoxy) diphenyl sulfone, 4-hydroxy-4'-(o-methyl benzoxy)diphenyl sulfone, 4-hydroxy-4'-(p-chloro benzoxy)diphenyl sulfone and 4-hydroxy-4'-oxyaryl diphenyl sulfone. These may be used alone or in combination.

In the thermosensitive coloring layer, the mixing ratio of the developer to the leuco dye is such that the developer is preferably 0.5 parts by mass to 10 parts by mass, more preferably 1 part by mass to 5 parts by mass, relative to 1 part by mass of the leuco dye.

Besides the above-described leuco dye and developer, it is possible to appropriately add, to the thermosensitive coloring layer, other materials customarily used in thermosensitive recording materials, such as a binder, a filler, a hot-meltable material, a crosslinking agent, a pigment, a surfactant, a fluorescent whitening agent and a lubricant.

The binder may be used if necessary in order to improve the adhesiveness and coatability of the layer. The binder is suitably selected depending on the intended purpose without any restriction. Specific examples of the binder resin include starches, hydroxyethyl cellulose, methyl cellulose, carboxy methyl cellulose, gelatin, casein, gum arabic, polyvinyl alcohols, salts of diisobutylene-maleic anhydride copolymers, salts of styrene-maleic anhydride copolymers, salts of ethylene-acrylic acid copolymers, salts of styrene-acryl copolymers and salt emulsions of styrene-butadiene copolymers.

The filler is suitably selected depending on the intended purpose without any restriction. Examples thereof include inorganic pigments such as calcium carbonate, aluminum oxide, zinc oxide, titanium dioxide, silica, aluminum hydroxide, barium sulfate, talc, kaolin, alumina and clay, and commonly known organic pigments. Among these, acidic pigments (those which exhibit acidity in aqueous solutions) such as silica, alumina and kaolin are preferable, with silica being particularly preferable from the viewpoint of developed color density.

The hot-meltable material is suitably selected depending on the intended purpose without any restriction. Examples thereof include fatty acids such as stearic acid and behenic acid; fatty acid amides such as stearic acid amide, erucic acid amide, palmitic acid amide, behenic acid amide and palmitic acid amide; N-substituted amides such as N-lauryl lauric acid amide, N-stearyl stearic acid amide and N-oleyl stearic acid amid; bis fatty acid amides such as methylene bis stearic acid amide, ethylene bis stearic acid amide, ethylene bis lauric acid amide, ethylene bis capric acid amide and ethylene bis behenic acid amide; hydroxyl fatty acid amides such as hydroxyl stearic acid amide, methylene bis hydroxyl stearic acid amide, ethylene bis hydroxyl stearic acid amide and hexamethylene bis hydroxy stearic acid amide; metal salts of fatty acids, such as zinc stearate, aluminum stearate, calcium stearate, zinc palmitate and zinc behenate; p-benzyl biphenyl, terphenyl, triphenyl methane, benzyl p-benzyloxybenzoate, β-benzyloxy naphthalene, phenyl β-naphthoate, 1-hydroxy-2-phenyl naphthoate, methyl 1-hydroxy-2-naphthoate, diphenyl carbonate, benzyl terephthalate, 1,4-dimethoxy naphthalene, 1,4-diethoxy naphthalene, 1,4-dibenzyloxy naphthalene, 1,2-diphenoxy ethane, 1,2-bis(4-methyl phenoxy ethane), 1,4-diphenoxy-2-butene, 1,2-bis(4-methoxy phenyl thio)ethane, dibenzoyl methane, 1,4-diphenylthio butane, 1,4-diphenylthio-2-butene, 1,3-bis(2-vinyloxy ethoxy)benzene, 1,4-bis(2-vinyloxy ethoxy)benzene, p-(2-vinyloxy ethoxy)biphenyl, p-aryloxy biphenyl, dibenzoyloxymethane, dibenzoyloxypropane, dibenzyl sulfide, 1,1-diphenyl ethanol, 1,1-diphenyl propanol, p-benzyloxy benzyl alcohol, 1,3-phenoxy-2-propanol, N-octadecyl carbamoyl-p-methoxy carbonyl benzene, N-octadecyl carbamoyl benzene, 1,2-bis(4-methoxyphenoxy)propane, 1,5-bis(4-methoxyphenoxy)-3-oxapentane, dibenzyl oxalate, bis(4-methyl benzyl)oxalate and bis(4-chlorobenzyl)oxalate. These may be used alone or in combination.

Further, it is preferred that diacetone-modified polyvinyl alcohol be incorporated into the thermosensitive coloring layer, when N-aminopolyacryl amide serving as a crosslinking agent is added to the thermosensitive coloring layer and the protective layer, a crosslinking reaction readily occurs, and water resistance can be improved without adding another crosslinking agent that could impede color development.

The thermosensitive coloring layer can be formed by commonly known methods. For example, a leuco dye and a developer have been pulverized and dispersed together with a binder and other components so as to have a particle diameter of 1 μm to 3 μm by a disperser such as a ball mill, an Atriter and a sand mill. The resultant dispersion is mixed, if necessary, together with a filler and a hot-meltable material (sensitizer) dispersion liquid in accordance with a predetermined formulation, to thereby prepare a coating liquid of a thermosensitive coloring layer, followed by applying the thus-prepared coating liquid onto a support.

The thickness of the thermosensitive coloring layer varies depending on the composition of the thermosensitive coloring layer and intended use of the thermosensitive recording materials and cannot be specified flatly, but it is preferably 1 μm to 50 μm, more preferably 3 μm to 20 μm.

<Protective Layer>

The protective layer contains at least a water-soluble resin and a fluorescent whitening agent, and further contains other components as necessary. By providing the protective layer, it is expected to further improve the light resistance while the background whiteness is maintained.

The protective layer may be a single layer or formed of two layers. It is preferred that a first protective layer containing the water-soluble resin and the fluorescent whitening agent, and a second protective layer containing the water-soluble resin but no fluorescent whitening agent be formed in this order over the thermosensitive coloring layer.

In this case, even though the amount of the fluorescent whitening agent is increased in the entire protective layer, background whiteness can be maintained while the background is suppressed from being turned into yellow color. Moreover, it can be expected to further improve the light resistance due to the fluorescent whitening agent, as well as improving the water resistance.

—First Protective Layer—

The first protective layer contains the fluorescent whitening agent and the water-soluble resin, and further contains a crosslinking agent.

—Fluorescent Whitening Agent—

The fluorescent whitening agent is suitably selected depending on the intended purpose without any restriction. A stilbene compound is preferable from the standpoint of exhibiting the excellent light resistance.

The stilbene compound is suitably selected depending on the intended purpose without any restriction. Examples thereof include 4,4'-bis(2-amino-4-anilino-1,3,5-triazinyl-6-amino)stilbene-2,2'-disulfonic acid, disodium 4,4'-bis(2,4-dianilino-1,3,5-triazin-6-yl-amino)stilbene-2,2'-disulfonic acid, 4,4'-bis(2-anilino-4-hydroxyethylamino-1,3,5-triazinyl-6-amino)stilbene disulfonic acid, sodium 4,4'-bis{2-anilino-4-di(hydroxyethyl)amino-1,3,5-triazinyl-(6)-amino}stilbene-2,2'-disulfonic acid, sodium 4,4'-bis[2-(2-methylanilino)-4-bis(hydroxyethyl)amino-1,3,5-triazinyl-6-amino]stilbene-2,2'-disulfonic acid, sodium 4,4'-bis{2-(m-sulfophenylamino)-4-(2-hydroxypropyl)amino-1,3,5-triazinyl-6-amino}stilbene-2,2'-disulfonic acid, sodium 4-[2-p-sulfoanilino-4-bis(hydroxyethyl)amino-1,3,5-triazinyl-6-amino]-4'-[2-m-sulfoanilino-4-bis(hydroxyethyl)amino-1,3,5-triazinyl-6-amino]stilbene-2,2'-disulfonic acid, sodium 4,4'-bis{2-sodiumsulfanyl-4-di(hydroxyethyl)amino-1,3,5-triazinyl-(6)-amino}stilbene-2,2'-disulfonic acid, 4,4'-bis[4-[3-acetylamino-4-(4,8-disulfo-2-naphthylazo)]anilino-6-(3-carboxypyridinio)-1,3,5-triazin-2-ylamino]-2,2'-disulfostilbene dihydroxide hexasodium salt, 4,4'-bis[4-[3-acetylamino-4-(4,8-disulfo-2-naphthylazo)]anilino-6-chloro-1,3,5-triazin-2-ylamino]-2,2'-stilbene disulfonic acid hexasodium salt, 4,4'-bis[4-[3-[3-carboxy-5-hydroxy-1-(p-sulfophenyl)-4-pyrazolylazo]-4-sulfoanilino]-6-chloro-1,3,5-triazin-2-ylamino]-2,2'-stilbene disulfonic acid octasodium salt, 4,4'-bis[4-chloro-6-[3-[1-(2-chloro-5-sulfophenyl)-5-hydroxy-3-methyl-4-pyrazolylazo]-4-sulfoanilino]-1,3,5-triazin-2-ylamino]-2,2'-stilbene disulfonic acid=hexasodium salt, 4,4'-bis[6-[N-(2-cyanoethyl)-N-[2-(2-hydroxyethoxy)ethyl]amino]-4-(2,5-disulfoanilino)-1,3,5-triazin-2-ylamino]-2,2'-stilbene disulfonic acid hexasodium salt, 4,4'-bis[4-bis(2-hydroxypropyl)amino-6-(4-sulfoanilino)-1,3,5-triazin-2-ylamino]-2,2'-stilbene disulfonic acid tetrasodium salt, 4-(4-amino-6-anilino-1,3,5-triazin-2-ylamino)-4'-(4,6-diamino-1,3,5-triazin-2-ylamino)-2,2'-stilbene disulfonic acid, calcium 4-(2,4-diamino-1,3,5-triazin-6-yl)amino-4'-(4-amino-2-chloro-6-yl)amino-2,2'-stilbene disulfonic acid, 4,4'-bis(4-amino-6-anilino-1,3,5-triazin-2-ylamino)-2,2'-stilbene disulfonic acid, dipotassium 4,4'-bis(4-amino-6-anilino-1,3,5-triazin-2-ylamino)-2,2'-stilbene disulfonic acid, potassium hydrogen 4,4'-bis(4-amino-6-anilino-1,3,5-triazin-2-ylamino)-2,2'-stilbene disulphonic acid, 4,4'-bis(4-amino-6-chloro-1,3,5-triazin-2-ylamino)-2,2'-stilbene disulfonic acid, dipotassium 4,4'-bis(4-amino-6-chloro-1,3,5-triazin-2-ylamino)-2,2'-stilbene disulfonic acid, calcium 4,4'-bis(6-amino-4-chloro-1,3,5-triazin-2-ylamino)-2,2'-stilbene disulfonic acid, potassium hydrogen 4,4'-bis(4-amino-6-chloro-1,3,5-triazin-2-ylamino)-2,2'-stilbene disulfonic acid, sodium hydrogen 4,4'-bis(4-amino-6-chloro-1,3,5-triazin-2-ylamino)-2,2'-stilbene disulfonic acid, disodium 4,4'-bis(4-amino-6-chloro-1,3,5-triazin-2-ylamino)-2,2'-stilbene disulfonic acid, 4,4'-bis[4-anilino-6-(p-sulfoanilino)-1,3,5-triazin-2-ylamino]-2,2'-stilbene disulfonic acid potassium salt (primary salt, secondary salt, tertiary salt, or quaternary salt), 4,4'-bis[4-anilino-6-(2-hydroxyethylamino)-1,3,5-triazin-2-ylamino]-2,2'-stilbene disulfonic acid, dipotassium 4,4'-bis[4-anilino-6-(2-hydroxyethylamino)-1,3,5-triazin-2-ylamino]-2,2'-stilbene disulfonic acid, potassium hydrogen 4,4'-bis[4-anilino-6-(2-hydroxyethylamino)-1,3,5-triazin-2-ylamino]-2,2'-stilbene disulfonic acid, disodium 4,4'-bis(4-anilino-6-methylamino-1,3,5-triazin-2-ylamino)-2,2'-stilbene disulfonic acid, 4,4'-bis[4-(2,5-disulfoanilino)-6-(2-hydroxypropylamino)-1,3,5-triazin-2-ylamino]-2,2'-stilbene disulfonic acid, 4,4'-bis[6-(m-sulfoanilino)-4-(2-hydroxydiethylamino)-1,3,5-triazin-2-ylamino]-2,2'-stilbene disulfonic acid, 4,4'-bis[6-(m-sulfoanilino)-4-(2-hydroxypropylamino)-1,3,5-triazin-2-ylamino]-2,2'-stilbene disulfonic acid, 4,4'-bis[6-(2-hydroxyethylamino)-4-anilino-1,3,5-triazin-2-ylamino]-2,2'-stilbene disulfonic acid, sodium hydrogen 4,4'-bis[4-bis(2-hydroxyethyl)amino-6-chloro-1,3,5-triazin-2-ylamino]-2,2'-stilbene disulfonic acid, 4,4'-bis(4-methylamino-6-phenylamino-1,3,5-triazin-2-ylamino)-2,2'-stilbene disulfonic acid, 4-[4-chloro-6-bis(2-hydroxyethyl)amino-1,3,5-triazin-2-ylamino]-4'-[4,6-bis [bis(2-hydroxyethyl)amino]-1,3,5-triazin-2-ylamino]-2,2'-stilbene disulfonic acid, 4,4'-bis[4-anilino-6-bis(2-hydroxyethyl)amino-1,3,5-triazin-2-ylamino]-2,2'-stilbene disulfonic acid, dipotassium 4,4'-bis[4-anilino-6-bis(2-hydroxyethyl)amino-1,3,5-triazin-2-ylamino]-2,2'-stilbene disulfonic acid, potassium hydrogen 4,4'-bis[4-anilino-6-bis(2-hydroxyethyl)amino-1,3,5-triazin-2-ylamino]-2,2'-stilbene disulfonic acid, dipotassium 4,4'-bis[4-anilino-6-[N-(2-hydroxyethyl)-N-methylamino]-1,3,5-triazin-2-ylamino]-2,2'-stilbene disulfonic acid, potassium hydrogen 4,4'-bis[4-anilino-6-[N-(2-hydroxyethyl)-N-methylamino]-1,3,5-triazin-2-ylamino]-2,2'-stilbene disulfonic acid, 4,4'-bis[4-(diethylamino)-6-(2,5-disulfoanilino)-1,3,5-triazin-2-ylamino]-2,2'-stilbene disulfonic acid sodium salt (primary salt, secondary salt, tertiary salt, quaternary salt, quinary salt, or senary salt), 4,4'-bis[6-(p-sulfamoylphenylamino)-4-bis(2-hydroxyethyl)amino-1,3,5-triazin-2-ylamino]-2,2'-stilbene disulfonic acid, 4,4'-bis[4-bis(2-hydroxyethyl)amino-6-(p-sulfamoylanilino)-1,3,5-triazin-2-ylamino]-2,2'-stilbene disulfonic acid, disodium 4,4'-bis[4-bis(2-hydroxyethyl)amino-6-chloro-1,3,5-triazin-2-ylamino]-2,2'-stilbene disulfonic acid, 4,4'-bis[6-bis(2-hydroxyethyl)amino-4-(2,5-disulfoanilino)-1,3,5-triazin-2-ylamino]-2,2'-stilbene disulfonic acid, 4,4'-bis[4-bis(2-hydroxyethyl)amino-6-(m-sulfoanilino)-1,3,5-triazin-2-ylamino]-2,2'-stilbene disulfonic acid, 4,4'-bis[4-bis(2-hydroxyethyl)amino-6-(p-sulfoanilino)-1,3,5-triazin-2-ylamino]-2,2'-stilbene disulfonic acid, 4,4'-bis[4-bis(2-hydroxyethyl)amino-6-(m-sulfoanilino)-1,3,5-triazin-2-ylamino]-2,2'-stilbene disulfonic acid potassium salt (primary salt, secondary salt, tertiary salt, or quaternary salt), 4,4'-bis[4-bis(2-hydroxyethyl)amino-6-(p-sulfophenoxy-1,3,5-triazin-2-ylamino)-2,2'-stilbene disulfonic acid, 4-[4-bis(2-hydroxyethyl)amino-6-(p-sulfoanilino)-1,3,5-triazin-2-ylamino]-4'[4-bis(2-hydroxyethyl)amino-6-(m-sulfoanilino)-1,3,5-triazin-2-ylamino]-2,2'-stilbene disulfonic acid, 4-[4-bis(2-hydroxyethyl)amino-6-(p-sulfoanilino)-1,3,5-triazin-2-ylamino]-4'-[4-bis(2-hydroxyethyl)amino-6-(m-sulfoanilino)-1,3,5-triazin-2-ylamino]-2,2'-stilbene disulfonic acid sodium salt (primary salt, secondary salt, tertiary salt, or quaternary salt), 4-[4-bis(2-hydroxyethyl)amino-6-methoxy-1,3,5-triazin-2-ylamino]-4'-(4-methoxy-6-morpholino-1,3,5-triazin-2-ylamino)-2,2'-stilbene disulfonic acid, 4-[4-bis(2-hydroxyethyl)amino-6-methoxy-1,3,5-triazin-2-ylamino]-4'-[4-(2-hydroxysulfonylethylamino)-6-methoxy-1,3,5-triazin-2-ylamino]-2,2'-stilbene disulfonic acid, disodium 4-(4-anilino-6-methoxy-1,3,5-triazin-2-ylamino)-4'-(4-chloro-6-methoxy-1,3,5-triazin-2-ylamino)-2,2'-stilbene disulfonic acid, 4-(4-anilino-6-methoxy-1,3,5-triazin-2-ylamino)-4'-(4,6-dimethoxy-1,3,5-triazin-2-ylamino)-2,2'-stilbene disulfonic acid, dipotassium 4-(4-anilino-6-methoxy-1,3,5-triazin-2-ylamino)-4'-(4,6-dimethoxy-1,3,5-triazin-2-ylamino)-2,2'-stilbene disulfonic acid, potassium hydrogen 4-(4-anilino-6-methoxy-1,3,5-triazin-2-ylamino)-4'-(4,6-dimethoxy-1,3,5-triazin-2-ylamino)-2,2'-stilbene disulfonic acid, sodium hydrogen 4-(4-anilino-6-methoxy-1,3,5-triazin-2-ylamino)-4'-(4,6-dimethoxy-1,3,5-triazin-2-ylamino)-2,2'-stilbene disulfonic acid, disodium 4-(4-anilino-6-methoxy-1,3,5-triazin-2-ylamino)-4'-(4,6-dimethoxy-1,3,5-triazin-2-ylamino)-2,2'-stilbene disulfonic acid, 4,4'-bis[6-(1-hydroxy-1-methylethylamino)-4-methoxy-1,3,5-triazin-2-ylamino]-2,2'-stilbene disulfonic acid, 4-(4-chloro-6-methoxy-1,3,5-triazin-2-ylamino)-4'-(4,6-dimethoxy-1,3,5-triazin-2-ylamino)-2,2'-stilbene disulfonic acid, dipotassium 4-(4-chloro-6-methoxy-1,3,5-triazin-2-ylamino)-4'-(4,6-dimethoxy-1,3,5-triazin-2-ylamino)-2,2'-stilbene disulfonic acid, potassium hydrogen 4-(4-chloro-6-methoxy-1,3,5-triazin-2-ylamino)-4'-(4,6-dimethoxy-1,3,5-triazin-2-ylamino)-2,2'-stilbene disulfonic acid, sodium hydrogen 4-(4-chloro-6-methoxy-1,3,5-triazin-2-ylamino)-4'-(4,6-dimethoxy-1,3,5-triazin-2-ylamino)-2,2'-stilbene disulfonic acid, disodium hydrogen 4-(4-chloro-6-methoxy-1,3,5-triazin-2-ylamino)-4'-(4,6-dimethoxy-1,3,5-triazin-2-ylamino)-2,2'-stilbene disulfonic acid, 4,4'-bis(4-anilino-6-methoxy-1,3,5-triazin-2-ylamino)-2,2'-stilbene disulfonic acid, 4,4'-bis[4-chloro-6-(p-sulfophenyloxy)-1,3,5-triazin-2-ylamino]-2,2'-stilbene disulfonic acid, 4,4'-bis[4-chloro-6-(p-sulfophenoxy)-1,3,5-triazin-2-ylamino]-2,2'-stilbene disulfonic acid disodium salt, 4,4'-bis[4-chloro-6-(p-sulfophenoxy)-1,3,5-triazin-2-ylamino]-2,2'-stilbene disulfonic acid sodium salt (primary salt, secondary salt, tertiary salt, or quaternary salt), 4,4'-bis[4-chloro-6-phenoxy-1,3,5-triazin-2-ylamino)-2,2'-stilbene disulfonic acid sodium salt (primary salt, or secondary salt), 4,4'-bis[4-chloro-6-methoxy-1,3,5-triazin-2-ylamino)-2,2'-stilbene disulfonic acid, dipotassium 4,4'-bis(4-chloro-6-methoxy-1,3,5-triazin-2-ylamino)-2,2'-stilbene disulfonic acid, potassium hydrogen 4,4'-bis(4-chloro-6-methoxy-1,3,5-triazin-2-ylamino)-2,2'- stilbene disulfonic acid, 4,4'-bis(4-chloro-6-methoxy-1,3,5-triazin-2-ylamino)-2,2'-stilbene disulfonic acid sodium salt (primary salt, or secondary salt), 4,4'-bis[4-(2-hydroxyethylamino)-6-phenoxy-1,3,5-triazin-2-ylamino]-2,2'-stilbene disulfonic acid, 4,4'-bis[4-(2-hydroxyethylamino)-6-methoxy-1,3,5-triazin-2-ylamino]-2,2'-stilbene disulfonic acid, 4,4'-bis(4-anilino-6-chloro-1,3,5-triazin-2-ylamino)-2,2'-stilbene disulfonic acid, dipotassium 4,4'-bis(4-anilino-6-chloro-1,3,5-triazin-2-ylamino)-2,2'-stilbene disulfonic acid, potassium hydrogen 4,4'-bis(4-anilino-6-chloro-1,3,5-triazin-2-ylamino)-2,2'-stilbene disulfonic acid, sodium hydrogen 4,4'-bis(4-anilino-6-chloro-1,3,5-triazin-2-ylamino)-2,2'-stilbene disulfonic acid, disodium hydrogen 4,4'-bis(4-anilino-6-chloro-1,3,5-triazin-2-ylamino)-2,2'-stilbene disulfonic acid, potassium sodium 4,4'-bis(4-anilino-6-chloro-1,3,5-triazin-2-ylamino)-2,2'-stilbene disulfonic acid, 4,4'-bis[4-chloro-6-(p-chloroanilino)-1,3,5-triazin-2-ylamino]-2,2'-stilbene disulfonic acid, sodium hydrogen 4,4'-bis[4-chloro-6-(p-chloroanilino)-1,3,5-triazin-2-ylamino]-2,2'-stilbene disulfonic acid, disodium hydrogen 4,4'-bis[4-chloro-6-(p-chloroanilino)-1,3,5-triazin-2-ylamino]-2,2'-stilbene disulfonic acid, 4,4'-bis[4-chloro-6-(2,5-disulfoanilino)-1,3,5-triazin-2-ylamino]-2,2'-stilbene disulfonic acid, 4,4'-bis[4-chloro-6-(2,5-disulfoanilino)-1,3,5-triazin-2-ylamino]-2,2'-stilbene disulfonic acid sodium salt (primary salt, secondary salt, tertiary salt, quaternary salt, quinary salt, or senary salt), disodium 4,4'-bis[4-chloro-6-(p-sulfamoylanilino)-1,3,5-triazin-2-ylamino]-2,2'-stilbene disulfonic acid, 4,4'-bis[4-chloro-6-(m-sulfoanilino)-1,3,5-triazin-2-ylamino]-2,2'-stilbene disulfonic acid, 4,4'-bis[4-chloro-6-(p-sulfoanilino)-1,3,5-triazin-2-ylamino]-2,2'-stilbene disulfonic acid, 4,4'-bis[4-chloro-6-(m-sulfoanilino)-1,3,5-triazin-2-ylamino]-2,2'-stilbene disulfonic acid potassium salt (primary salt, secondary salt, tertiary salt, or quaternary salt), 4,4'-bis[4-chloro-6-(p-sulfoanilino)-1,3,5-triazin-2-ylamino]-2,2'-stilbene disulfonic acid potassium salt (primary salt, secondary salt, tertiary salt, or quaternary salt), 4,4'-bis[4-chloro-6-(2,5-disulfoanilino)-1,3,5-triazin-2-ylamino]-2,2'-stilbene disulfonic acid hexapotassium salt, 4,4'-bis[4-chloro-6-(p-sulfoanilino)-1,3,5-triazin-2-ylamino]-2,2'-stilbene disulfonic acid sodium salt (primary salt, secondary salt, tertiary salt, or quaternary salt), 4,4'-bis[4-chloro-6-(m-sulfoanilino)-1,3,5-triazin-2-ylamino]-2,2'-stilbene disulfonic acid sodium salt (primary salt, secondary salt, tertiary salt, or quaternary salt), 4,4'-bis[4-chloro-6-(2-sulfoethylamino)-1,3,5-triazin-2-ylamino]-2,2'-stilbene disulfonic acid, 4,4'-bis[4-chloro-6-(2-sulfoethylamino)-1,3,5-triazin-2-ylamino]-2,2'-stilbene disulfonic acid potassium salt (primary salt, secondary salt, tertiary salt, or quaternary salt), 4,4'-bis[4-chloro-6-(2-sulfoethylamino)-1,3,5-triazin-2-ylamino]-2,2'-stilbene disulfonic acid sodium salt (primary salt, secondary salt, tertiary salt, or quaternary salt), 4,4'-bis[4-chloro-6-(o-toluidino)-1,3,5-triazin-2-ylamino]-2,2'-stilbene disulfonic acid, dipotassium 4,4'-bis[4-chloro-6-(o-toluidino)-1,3,5-triazin-2-ylamino]-2,2'-stilbene disulfonic acid, potassium hydrogen 4,4'-bis[4-chloro-6-(o-toluidino)-1,3,5-triazin-2-ylamino]-2,2'-stilbene disulfonic acid, sodium hydrogen 4,4'-bis[4-chloro-6-(o-toluidino)-1,3,5-triazin-2-ylamino]-2,2'-stilbene disulfonic acid, disodium hydrogen 4,4'-bis[4-chloro-6-(o-toluidino)-1,3,5-triazin-2-ylamino]-2,2'-stilbene disulfonic acid, sodium hydrogen 4,4'-bis[4-chloro-6-(2-hydroxyethylamino)-1,3,5-triazin-2-ylamino]-2,2'-stilbene disulfonic acid, disodium 4,4'-bis[4-chloro-6-(2-hydroxyethylamino)-1,3,5-triazin-2-ylamino]-2,2'-stilbene disulfonic acid, 4,4'-bis[4-chloro-6-(2-hydroxyethylamino)-1,3,5-triazin-2-ylamino]-2,2'-stilbene disulfonic acid, 4,4'-bis[4-chloro-6-(7-phenylazo-8-disulfo-1-naphtylamino)-1,3,5-triazin-2-ylamino]-2,2'-stilbene disulfonic acid sodium salt (primary salt, secondary salt, tertiary salt, quaternary salt, quinary salt, or senary salt), 4,4'-bis[4-chloro-6-(7-phenylazo-8-hydroxy-2,5-disulfo-1-naphthylamino)-1,3,5-triazin-2-ylamino]-2,2'-stilbene disulfonic acid sodium salt (primary salt, secondary salt, tertiary salt, quaternary salt, quinary salt, or senary salt), disodium 4,4'-bis[4-chloro-6-(o-methylanilino)-1,3,5-triazin-2-ylamino]-2,2'-stilbene disulfonic acid, 4,4'-bis(4,6-dichloro-1,3,5-triazin-2-ylamino)-2,2'-stilbene disulfonic acid, calcium 4,4'-bis(4,6-dichloro-1,3,5-triazin-2-ylamino)-2,2'-stilbene disulfonic acid, sodium hydrogen 4,4'-bis(4,6-dichloro-1,3,5-triazin-2-ylamino)stilbene-2,2'-disulfonic acid, 4,4'-bis[4-morpholino-6-(p-sulfoanilino)-1,3,5-triazin-2-ylamino]-2,2'-stilbene disulfonic acid, 4,4'-bis[4-morpholino-6-(2-sulfoethylamino)-1,3,5-triazin-2-ylamino]-2,2'-stilbene disulfonic acid potassium salt (primary salt, secondary salt, tertiary salt, or quaternary salt), 4,4'-bis[4-morpholino-6-(o-toluidino)-1,3,5-triazin-2-ylamino]-2,2'-stilbene disulfonic acid, dipotassium 4,4'-bis[4-morpholino-6-(o-toluidino)-1,3,5-triazin-2-ylamino]-2,2'-stilbene disulfonic acid, potassium hydrogen 4,4'-bis[4-morpholino-6-(o-toluidino)-1,3,5-triazin-2-ylamino]-2,2'-stilbene disulfonic acid, disodium 4-(4-chloro-6-methoxy-1,3,5-triazin-2-ylamino)-4'-(4-methoxy-6-morpholino-1,3,5-triazin-2-ylamino)-2,2'-stilbene disulfonic acid, 4,4'-bis[4-chloro-6-morpholino-1,3,5-triazin-2-ylamino)-2,2'-stilbene disulfonic acid, sodium hydrogen 4,4'-bis[4-chloro-6-morpholino-1,3,5-triazin-2-ylamino)-2,2'-stilbene disulfonic acid, disodium 4,4'-bis[4-chloro-6-morpholino-1,3,5-triazin-2-ylamino)-2,2'-stilbene disulfonic acid, 4,4'-bis(4,6-dimorpholino-1,3,5-triazin-2-ylamino)-2,2'-stilbene disulfonic acid, and disodium 4,4'-bis[4,6-dimorpholino-1,3,5-triazin-2-ylamino)-2,2'-stilbene disulfonic acid. These may be used alone or in combination.

In the thermosensitive recording material, the dry mass of the fluorescent whitening agent in the first protective layer is preferably 0.5 g/m$^2$ to 1.5 g/m$^2$, and the amount of the fluorescent whitening agent in the first protective layer is preferably 20% by mass or more relative to the total amount of the first protective layer.

When the dry mass of the fluorescent whitening agent is less than 0.5 g/m$^2$, the light resistance cannot be sufficiently obtained. When the dry mass is more than 1.5 g/m$^2$, the degree of the light resistance is not changed, but the deposition amount of the entire protective layer is required to increase so as to prevent the background of the thermosensitive recording material from turning into yellow color, possibly causing decrease in coloring properties.

When the amount of the fluorescent whitening agent is less than 20% by mass, it is necessary to increase the deposition amount of the first protective layer in order to obtain a predetermined amount of the fluorescent whitening agent, possibly causing decrease in the coloring properties of the thermosensitive recording material. From these standpoints, the amount is preferably 30% by mass or more.

The maximum amount is preferably 80% by mass or less in terms of making the thermosensitive recording material water resistance.

The dry mass and amount of the fluorescent whitening agent in the first protective layer are measured as follows. The first protective layer is separated from the thermosensitive recording material, followed by dissolving the first protective layer in a solvent, and then component analysis is performed on the resulting solution by HPLC analysis, IR analysis, or mass spectrometry, etc.

—Water-Soluble Resin—

The water-soluble resin is suitably selected depending on the intended purpose without any restriction. Examples thereof include polyvinyl alcohol, modified polyvinyl alcohol, starch and derivatives thereof, cellulose derivatives, poly (meth)acrylate and alkali salts thereof, poly(meth)acrylamide and alkali salts thereof, (meth)acrylamide copolymers and alkali salts thereof, alkali salts of styrene-maleic anhydride copolymers, polyvinylpyrrolidone, polyethyleneimine, alginate soda, gelatin and casein.

As the water-soluble resin, an aqueous emulsion resin may be used. Examples thereof include emulsions of, for example, acryl copolymers, acrylic acid copolymers, (meth)acrylate copolymers, urethane resins, epoxy resins, vinyl acetate (co) polymers, vinylidene chloride (co)polymers, vinyl chloride (co)polymers; latexes of, for example, styrene-butadiene copolymers, and styrene-butadiene-acryl copolymers.

Among these, polyvinyl alcohol, and diacetone-modified polyvinyl alcohol are preferable, in term of barrier properties, head matching properties, and mechanical strength.

—Crosslinking Agent—

The crosslinking agent is suitably selected depending on the intended purpose without any restriction. Examples thereof include polyvalent amine compounds such as ethylene diamine; polyvalent aldehyde compounds such as glyoxal, glutalaldehyde and dialdehyde; dihydrazide compounds such as dihydrazide adipate and dihydrazide phthalate; polyamide-epichlorohydrin compounds; water-soluble methylol compounds (urea, melamine and phenol); multifunctional epoxy compounds; multivalent metal salts (e.g., Al, Ti, Zr and Mg); titanium lactate; and boric acid.

The amount of the crosslinking agent in the first protective layer is suitably selected depending on the intended purpose without any restriction. The amount of the crosslinking agent varies depending on the amounts and types of functional groups of the crosslinking agent, but it is preferably 0.1 parts by mass to 100 parts by mass, more preferably 1 part by mass to 50 parts by mass, relative to 100 parts by mass of the binder resin.

—Second Protective Layer—

The second protective layer contains the water-soluble resin but no fluorescent whitening agent, and further contains a crosslinking agent, an inorganic filler, and a lubricant, and the like.

—Water-Soluble Resin—

The water-soluble resin is suitably selected depending on the intended purpose without any restriction. For example, the water-soluble resins used in the first protective layer may be used. As the water-soluble resin used in the second protective layer, the same as or different from the water-soluble resin used in the first protective layer may be used.

As the water-soluble resin used in the second protective layer, a polyvinyl alcohol resin is preferably used similarly in the first protective layer.

—Crosslinking Agent—

The crosslinking agent is suitably selected depending on the intended purpose without any restriction. For example, the crosslinking agent used in the first protective layer may be used. It is noted that as the crosslinking agent used in the second protective layer, the same as or different from the crosslinking agent used in the first protective layer may be used.

The amount of the crosslinking agent in the second protective layer is suitably selected depending on the intended purpose without any restriction. The amount of the crosslinking agent varies depending on the amounts and types of functional groups of the crosslinking agent, but it is preferably 0.1 parts by mass to 100 parts by mass, more preferably 1 part by mass to 50 parts by mass, relative to 100 parts by mass of the binder resin.

—Inorganic Filler—

The inorganic filler is suitably selected depending on the intended purpose without any restriction. Examples the inorganic filler include aluminum hydroxide, calcium carbonate, aluminum oxide, zinc oxide, titanium dioxide, silica, barium sulfate, talc, kaolin, alumina and clay. These may be used alone or in combination.

Among these, aluminum hydroxide, and calcium carbonate are particularly preferable because the protective layer containing such inorganic filler is provided with excellent abrasion resistance with respect to a thermal head when printing is performed for a long period of time.

The amount of the inorganic filler in the second protective layer is suitably selected depending on the intended purpose without any restriction. The amount of the inorganic filler depends on types of the filler, but it is preferably 50 parts by mass to 500 parts by mass, relative to 100 parts by mass of the binder resin.

—Lubricant—

The lubricant is suitably selected depending on the intended purpose without any restriction. Examples thereof include higher fatty acids such as zinc stearate, calcium stearate, montanate wax, polyethylene wax, carnauba wax, paraffin wax, ester wax and metal salts thereof higher fatty acid amides, higher fatty acid esters, animal wax, vegetable wax, mineral wax, and petroleum wax.

In the thermosensitive recording material, the amount of the fluorescent whitening agent is preferably 55% by mass or less relative to the total amount of the fluorescent whitening agent contained in the first protective layer and the water-soluble resin contained in the first protective layer and the second protective layer.

When the amount is more than 55% by mass, the water resistance of the thermosensitive recording material becomes poor, and peeling may occur.

The minimum amount of the fluorescent whitening agent is preferably 20% by mass or more in terms of the decrease in the coloring properties caused by the increase of the total amount of the protective layers.

The amount of the fluorescent whitening agent in the total amount of the fluorescent whitening agent contained in the first protective layer and the water-soluble resin contained in the first protective layer and the second protective layer is measured as follows. The first protective layer and the second protective layer are both separated from the thermosensitive recording material, followed by dissolving each layer in a solvent, and then component analysis is performed on each resulting solution by HPLC analysis, IR analysis, or mass spectrometry, etc.

A method for forming the first protective layer and the second protective layer is suitably selected depending on the intended purpose without any restriction. Examples thereof include blade coating, roll coating, wire bar coating, die coating, and curtain coating.

<Other Layers>

—Back Layer—

The thermosensitive recording material preferably contains a back layer containing a pigment, a water-soluble resin (binder resin) and a crosslinking agent, disposed on the surface of the support opposite to the surface thereof where the undercoat layer is disposed.

The back layer may further contain other components such as a filler, a lubricant, an antistatic agent, and the like.

As for the binder resin, either of a water-dispersible resin or a water-soluble resin is used. Specific examples thereof include conventionally known water-soluble polymers, and aqueous polymer emulsions.

The water-soluble polymer is suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, alginate soda, gelatin and casein. These may be used alone or in combination.

The aqueous polymer emulsion is suitably selected depending on the intended purpose without any restriction. Examples thereof include latexes of, for example, acrylate copolymers, styrene-butadiene copolymers and styrene-butadiene-acryl copolymers; and emulsions of, for example, vinyl acetate resins, vinyl acetate-acrylate copolymers, styrene-acrylate copolymers, acrylate resins and polyurethane resins. These may be used alone or in combination.

As the crosslinking agent, the same crosslinking agent as those in the second protective layer may be used.

As the filler, either an inorganic filler or an organic filler may be used.

Examples of the inorganic filler include carbonates, silicates, metal oxides and sulfate compounds. Examples of the organic filler include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins and polymethyl methacrylate resins.

A method for forming the back layer is suitably selected depending on the intended purpose without any restriction. The back layer is preferably formed by applying a coating liquid of the back layer to a support.

The coating method is suitably selected depending on the intended purpose without any restriction. Examples thereof include blade coating, roll coating, wire bar coating, die coating, and curtain coating.

The thickness of the back layer is suitably selected depending on the intended purpose without any restriction. It is preferably 0.1 μm to 10 μm, more preferably 0.5 μm to 5 μm.

The layer structure of the thermosensitive recording material of the first embodiment will be described with reference to the drawings.

FIG. 1 shows a schematic cross sectional view showing an example of a layer structure of a thermosensitive recording material 1 of the first embodiment of the present invention.

A thermosensitive recording material 1 includes, a support 2, a undercoat layer 3 containing a water-soluble resin, a thermosensitive coloring layer 4, a first protective layer 5 containing a water-soluble resin and a fluorescent whitening agent, and a second protective layer 6 containing a water-soluble resin but no fluorescent whitening agent, wherein the undercoat layer 3, the thermosensitive coloring layer 4, the first protective layer 5, and the second protective layer 6 are formed in this order over the support 2.

In the thermosensitive recording material 1, between the support 2 and the thermosensitive coloring layer 4, the undercoat layer 3 which suppresses the air permeance equal to or less than a predetermined value is provided, so as to suppress the light degradation of the thermosensitive coloring layer 4. Moreover, owing to the first protective layer 5 and the second protective layer 6, while the background whiteness is maintained, the light resistance can be improved.

Figure 2:
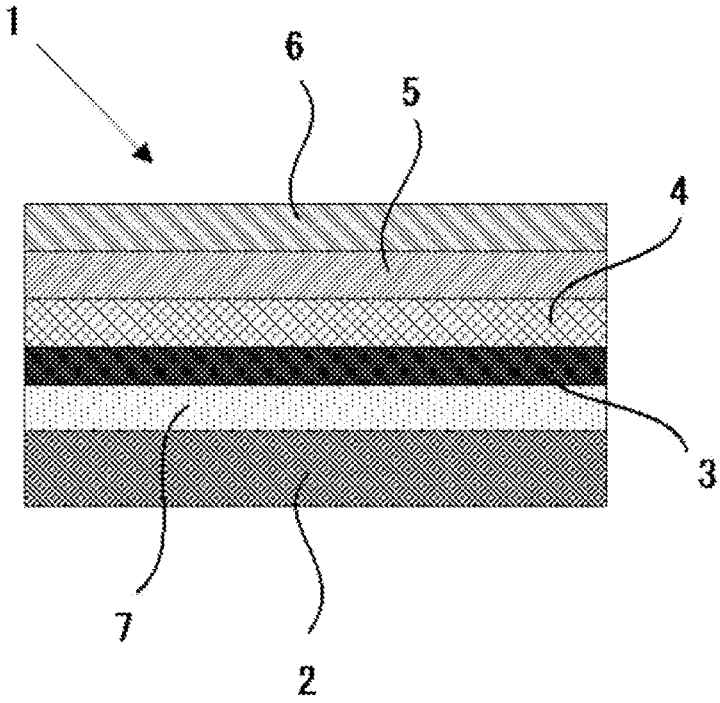
FIG. 2 shows a schematic cross sectional view showing another example of a layer structure of a thermosensitive recording material of the first embodiment of the present invention.

FIG. 2 shows a schematic cross sectional view showing another example of a layer structure of a thermosensitive recording material 1 of the first embodiment of the present invention.

A thermosensitive recording material 1 includes over a support 2, a second undercoat layer 7 containing hollow particles, first undercoat layer 3 containing a water-soluble resin, a thermosensitive coloring layer 4, a first protective layer 5 containing a water-soluble resin and a fluorescent whitening agent, and a second protective layer 6 containing a water-soluble resin but no fluorescent whitening agent, wherein the second undercoat layer 7, the first undercoat layer 3, the thermosensitive coloring layer 4, the first protective layer 5, and the second protective layer 6 are formed in this order over the support 2.

Since the thermosensitive recording material 1 includes a second undercoat layer 7 containing hollow particles formed over the support in addition to the first undercoat layer 3 containing the water-soluble resin, the coloring sensitivity of the thermosensitive coloring layer 4 can be improved by the second undercoat layer 7.

(Thermosensitive Recording Material of the Second Embodiment)

The thermosensitive recording material of the second embodiment includes a thermosensitive coloring layer, a first protective layer and a second protective layer, wherein the first protective layer and the second protective layer are formed in this order over the thermosensitive coloring layer, and includes a support, and further includes other layers as necessary.

<First Protective Layer>

The first protective layer contains a fluorescent whitening agent and a water-soluble resin, and further contains a crosslinking agent as necessary.

As the fluorescent whitening agent, the water-soluble resin, and the crosslinking agent, the same as those in the thermosensitive recording material of the first embodiment are used, and the first protective layer of the second embodiment can be formed in the same manner as the first protective layer of the first embodiment.

In the thermosensitive recording material, the dry mass of the fluorescent whitening agent in the first protective layer is 0.5 g/m$^2$ to 1.5 g/m$^2$, and the amount of the fluorescent whitening agent in the first protective layer is 20% by mass or more relative to the total amount of the first protective layer.

When the dry mass of the fluorescent whitening agent is less than 0.5 g/m$^2$, the light resistance cannot be sufficiently obtained. When the dry mass is more than 1.5 g/m$^2$, the degree of the light resistance is not changed, but the deposition amount of the entire protective layer is required to increase so as to prevent the background of the thermosensitive recording material from turning into yellow color, and the coloring properties may decrease.

When the amount of the fluorescent whitening agent is less than 20% by mass, it is necessary to increase the deposition amount of the first protective layer in order to obtain a predetermined amount of the fluorescent whitening agent, possibly causing decease in the coloring properties of the thermosensitive recording material. From these standpoints, the amount is preferably 30% by mass or more.

The maximum amount of the fluorescent whitening agent is preferably 80% by mass or less in terms of making the thermosensitive recording material water resistance.

The dry mass and amount of the fluorescent whitening agent in the first protective layer are measured as follows. The first protective layer is separated from the thermosensitive recording material, followed by dissolving the first protective layer in a solvent, and then component analysis is performed on the resulting solution by HPLC analysis, IR analysis, or mass spectrometry, etc.

<Second Protective Layer>

The second protective layer contains a water-soluble resin but does not contain a fluorescent whitening agent, and further contains a crosslinking agent, an inorganic filler, and a lubricant as necessary.

As the water-soluble resin, the crosslinking agent, the inorganic filler and the lubricant, the same as those in the thermosensitive recording material of the first embodiment are used, and the second protective layer of the second embodiment can be formed in the same manner as the second protective layer of the first embodiment.

In the thermosensitive recording material, the amount of the fluorescent whitening agent is 55% by mass or less relative to the total amount of the fluorescent whitening agent contained in the first protective layer and the water-soluble resin contained in the first protective layer and the second protective layer.

When the amount of the fluorescent whitening agent is more than 55% by mass, the water resistance of the thermosensitive recording material becomes poor, and peeling may occur.

The minimum amount of the fluorescent whitening agent is preferably 20% by mass or more in terms of decrease in the coloring properties caused by the increase in the total deposition amount of the protective layers.

The amount of the fluorescent whitening agent relative to the total amount of the fluorescent whitening agent contained in the first protective layer and the water-soluble resin contained in the first protective layer and the second protective layer is measured as follows. The first protective layer and the second protective layer are both separated from the thermosensitive recording material, followed by dissolving each layer in a solvent, and then component analysis is performed on each resulting solution by HPLC analysis, IR analysis, or mass spectrometry, etc.

<Thermosensitive Coloring Layer>

As the thermosensitive coloring layer, the same as that in the thermosensitive recording material of the first embodiment is used, and the thermosensitive coloring layer of the second embodiment is formed in the same manner as that in the first embodiment.

—Support—

As the support, the same as that in the thermosensitive recording material of the first embodiment can be used.

<Other Layers>

Other layers are suitably selected depending on the intended purpose without any restriction. Examples thereof include an undercoat layer, and a back layer.

—Undercoat Layer—

The thermosensitive recording material may include an undercoat layer containing hollow particles between the support and the thermosensitive coloring layer. Thus, thermal insulation properties, and adhesion properties to the head are improved, to thereby improve the coloring sensitivity.

The undercoat layer contains hollow particles each having a hollow ratio of 80% or more, and a binder, and further contains other components as necessary.

The hollow particles each preferably have a hollow ratio of 80% or more, more preferably 90% or more. When the hollow ratio is less than 80%, thermal insulating properties and cushioning properties are insufficient. In the case where image formation is performed using a thermal head, heat energy from the thermal head is emitted to the outside of the thermosensitive recording material via the support, and the adhesion properties between the thermal head and the thermosensitive recording material becomes poor, causing less effect on improving sensitivity and fineness. The practically obtainable hollow particles each have a hollow ratio of 98% or less.

The hollow ratio referred to herein is expressed by the following equation:

$$\text{Hollow ratio (\%)} = (\text{inner diameter of a hollow particle} / \text{outer diameter of the hollow particle}) \times 100$$

Each of the hollow particles has a shell made of a thermoplastic resin and contains therein air or other gas. They are fine hollow particles already in a foamed state, and those having a volume average particle diameter of 2 μm to 10 μm are preferably used.

When the volume average particle diameter (outer particle diameter) is less than 2 μm, there is a production problem of difficulty in obtaining given hollow ratio. When the volume average particle diameter is more than 10 μm, the smoothness of the dried coated surface decreases, causing decrease in adhesion properties between the thermal head and the thermosensitive recording material, and less effect on improving sensitivity. Accordingly, the hollow particles preferably have a sharp distribution peak with little variation as well as a volume average particle diameter falling within the aforementioned range.

The hollow particles are particles each having a thermoplastic resin as a shell, and examples of the thermoplastic resin include polystyrene, polyvinyl chloride, polyvinylidene chloride, polyvinyl acetate, polyacrylic ester, polyacrylonitrile, and polybutadiene, and copolymer resins thereof. Among these, the copolymer resins which contain vinylidene chloride and acrylonitrile as main constituents are particularly preferable.

The binder is suitably selected from at least any one of conventionally known water-soluble polymers and conventionally known aqueous polymer emulsions depending on the intended purpose without any restriction.

Examples of the water-soluble polymers include polyvinyl alcohol, starch and derivatives thereof, cellulose derivatives such as methoxy cellulose, hydroxy ethyl cellulose, carboxy methyl cellulose, methyl cellulose and ethyl cellulose; polyacrylate soda, polyvinyl pyrrolidone, acryl amide-acrylate copolymers, acryl amide-acrylate-methacrylic acid terpolymers, alkali salts of styrene-maleic anhydride copolymers, alkali salts of isobutylene-maleic anhydride copolymers, polyacrylamide, alginate soda, gelatin and casein.

Examples of the aqueous polymer emulsions include latexes of, for example, styrene-butadiene copolymers and styrene-butadiene-acryl copolymers; and emulsions of, for example, a vinyl acetate resin, vinyl acetate-acrylate copolymers, styrene-acrylate copolymers, acrylate resins and polyurethane resins. These may be used alone or in combination.

The undercoat layer is formed by dispersing the hollow particles and the binder in water, followed by applying the resultant liquid onto a surface of the support, and then drying. In this case, the coating amount of the hollow particles is preferably 1 g or more, more preferably 2 g to 15 g, per square meter of the support. The coating amount of the binder is an amount sufficient enough to strongly bind the undercoat layer with support, and preferably 2% by mass to 50% by mass relative to the total amount of the hollow particles and the binder.

—Back Layer—

As the back layer, the same as that in the thermosensitive recording material of the first embodiment is used, and the back layer of the second embodiment can be formed in the same manner as that in the first embodiment.

The layer structure of the thermosensitive recording material of the second embodiment will be described with reference to the drawings.

Figure 3:
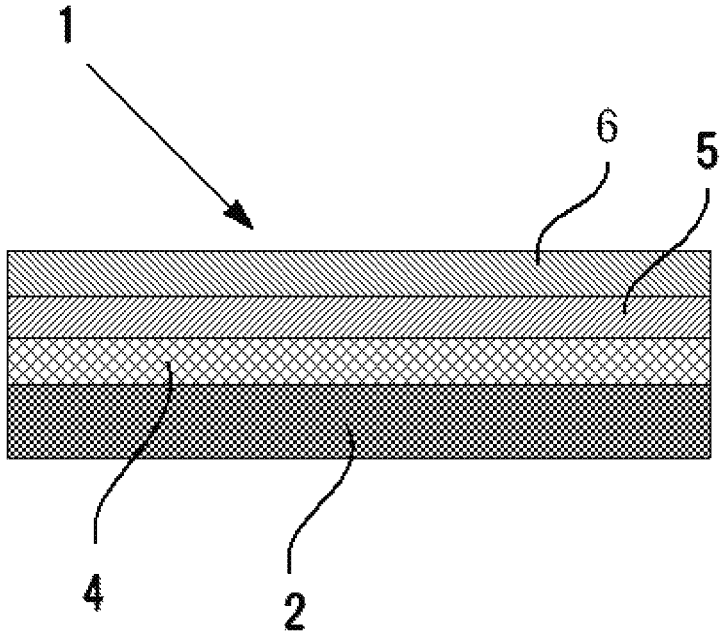
FIG. 3 shows a schematic cross sectional view showing an example of a layer structure of a thermosensitive recording material of the second embodiment of the present invention.

FIG. 3 shows a schematic cross sectional view showing an example of a layer structure of a thermosensitive recording material 1 of one embodiment of the present invention.

The thermosensitive recording material 1 includes a support 2, a thermosensitive coloring layer 4, a first protective layer 5, and a second protective layer 6, wherein the thermosensitive coloring layer 4, the first protective layer 5, and the second protective layer 6 are formed in this order over the support 2.

It is note that the layer structure of the thermosensitive recording material 1 is one example, and an undercoat layer may be provided between the support 2 and the thermosensitive coloring layer 4, and a back layer may be disposed on the surface (back surface) of the support 2 opposite to the surface thereof where the thermosensitive coloring layer 4 is disposed.

(Image Recording Method)

An image recording method of the present invention includes recording an image on the thermosensitive recording material of any of the first and second embodiments of the present invention using an image recording unit, which is any one of a thermal head and a laser.

The thermal head is suitably selected depending on the intended purpose without any restriction regarding the shape, structure and size thereof.

The laser is suitably selected depending on the intended purpose without any restriction. A $CO_2$ laser which emits light having a wavelength of 9.3 μm to 10.6 μm is preferably used.

By using the $CO_2$ laser which emits light having a wavelength of 9.3 μm to 10.6 μm, a satisfiable laser print image can be obtained without using a photothermal conversion agent such as a phthalocyanine pigment.

EXAMPLES

Hereinafter, the present invention will be specifically described based on Examples and Comparative Examples. However, it should be noted that the present invention is not confined to these Examples in any way. It should be noted that in the following examples, the unit "part(s) means "part(s) by mass" and the unit "%" means "% by mass" unless otherwise specified.

Example A1

(1) Preparation of a Coating Liquid of an Undercoat Layer

[Liquid A]

| | |
|---|---|
| 10% aqueous polyvinyl alcohol solution | 100 parts |
| Aluminum hydroxide dispersion liquid (solid content: 30%) | 30 parts |
| Water | 90 parts |

The materials of the aforementioned compositions were mixed and stirred to prepare a coating liquid of an undercoat layer [Liquid A].

(2) Preparation of a Coating Liquid of a Thermosensitive Coloring Layer

[Liquid B]

| | |
|---|---|
| 2-anilino-3-methyl-6-(di-n-butylamino)fluoran | 20 parts |
| 10% itaconic-modified polyvinyl alcohol aqueous solution | 20 parts |
| Water | 60 parts |

[Liquid C]

| | |
|---|---|
| 4-hydroxy-4'-allyloxydiphenylsulfone | 20 parts |
| 10% itaconic-modified polyvinyl alcohol aqueous solution | 20 parts |
| Silica (MIZUKASIL P-527 manufactured by MIZUSAWA INDUSTRIAL CHEMICALS, LTD.) | 10 parts |
| Water | 50 parts |

[Liquid B] and [Liquid C] having the aforementioned compositions respectively, were each dispersed using a sand mill, so that particles contained in each liquid had an average particle diameter of 1.0 μm or less, to thereby prepare a dye dispersion liquid [Liquid B] and a developer dispersion liquid [Liquid C].

Then, [Liquid B] and [Liquid C] were mixed in the ratio of 1/3, so as to adjust the solid content to 25%, followed by stirring, to thereby prepare a coating liquid of a thermosensitive coloring layer [Liquid D].

(3) Preparation of a Coating Liquid of a Protective Layer

[Liquid E]

| | |
|---|---|
| 10% diacetone-modified polyvinyl alcohol aqueous solution | 100 parts |
| 10% adipic acid dihydrazide aqueous solution | 20 parts |
| Dispersion liquid of aluminum hydroxide (solid content: 30%) | 50 parts |
| Montanate wax (solid content: 30%) | 3.3 parts |
| Fluorescent whitening agent (stilbene compound, Tinopal UP, solid content: 45%, manufactured by BASF) | 14.4 parts (solid content: 6.5 parts) |
| Water | 90 parts |

The materials of the aforementioned compositions were mixed and stirred to thereby prepare a coating liquid of a second protective layer [Liquid E].

Next, the coating liquid of the undercoat layer [Liquid A] was uniformly applied to a surface of a base paper support (woodfree paper having a basis weight of about 60 g/m$^2$) so as to have a deposition amount of 0.6 g/m$^2$ on dry basis, and then dried, to thereby form an undercoat layer. The [Liquid D] was uniformly applied to the undercoat layer so as to have a deposition amount of 3.0 g/m$^2$ on dry basis, and then dried, to thereby form a thermosensitive coloring layer.

Next, to the thermosensitive coloring layer, the coating liquid of a protective layer [Liquid E] was uniformly applied so as to have a deposition amount of 4.0 g/m$^2$ on dry basis, and then dried, to thereby form a protective layer, followed by performing surface treatment by supercalendering, to thereby produce a thermosensitive recording material of Example A1. The air permeance of the undercoat layer of the thermosensitive recording material of Example A1 was 150 mL/min.

Example A2

A thermosensitive recording material of Example A2 was produced in the same manner as in Example A1, except that the deposition amount of the undercoat layer was changed from 0.6 g/m$^2$ to 1.0 g/m$^2$. The air permeance of the undercoat layer of the thermosensitive recording material of Example A2 was 50 mL/min.

Example A3

A thermosensitive recording material of Example A3 was produced in the same manner as in Example A2, except that instead of [Liquid E], [Liquid F] and [Liquid G] were used to form a first protective layer and a second protective layer in the following manner.

(1) Preparation of a Coating Liquid of a First Protective Layer

[Liquid F]

| | |
|---|---|
| 10% diacetone-modified polyvinyl alcohol aqueous solution | 100 parts |
| 10% adipic acid dihydrazide aqueous solution | 20 parts |
| Fluorescent whitening agent (stilbene compound, Tinopal UP, solid content: 45%, manufactured by BASF) | 21.1 parts (solid content: 9.5 parts) |
| Water | 100 parts |

The materials of the aforementioned compositions were mixed and stirred to thereby prepare a coating liquid of a first protective layer [Liquid F].

(2) Preparation of a Coating Liquid of a Second Protective Layer

[Liquid G]

| | |
|---|---|
| 10% diacetone-modified polyvinyl alcohol aqueous solution | 100 parts |
| 10% adipic acid dihydrazide aqueous solution | 20 parts |
| Dispersion liquid of aluminum hydroxide (solid content: 30%) | 50 parts |
| Montanate wax (solid content: 30%) | 3.3 parts |
| Water | 90 parts |

The materials of the aforementioned compositions were mixed and stirred to thereby prepare a coating liquid of a second protective layer [Liquid G].

Over the thermosensitive coloring layer, the coating liquid of a first protective layer [Liquid F] was uniformly applied so as to have a deposition amount of 1.7 g/m$^2$ on dry basis, and then dried, and the coating liquid of a second protective layer [Liquid G] was uniformly applied so as to have a deposition amount of 2.0 g/m$^2$ on dry basis, and then dried, to thereby form a first protective layer and a second protective layer in this order over the thermosensitive coloring layer, followed by performing surface treatment by supercalendering, to thereby produce a thermosensitive recording material of Example A3.

Example A4

A thermosensitive recording material of Example A4 was produced in the same manner as in Example A3, except that instead of [Liquid A], [Liquid H] was used so as to form an undercoat layer as described below. The air permeance of the undercoat layer of the thermosensitive recording material of Example A4 was 30 mL/min.

(1) Preparation of a Coating Liquid of an Undercoat Layer

[Liquid H]

The materials of the following compositions were mixed, stirred and dispersed, to thereby prepare a coating liquid of an undercoat layer [Liquid H].

[Liquid H]

| | |
|---|---|
| Plastic spherical hollow particles (hollow ratio: 90%, solid content: 33%) | 15.15 parts |
| 10% aqueous polyvinyl alcohol solution | 100 parts |
| Water | 50 parts |

The coating liquid of an undercoat layer [Liquid H] was uniformly applied to a surface of a base paper support so as to have a deposition amount of 3.0 g/m$^2$ on dry basis, and then dried, to thereby form an undercoat layer.

Example A5

A thermosensitive recording material of Example A5 was produced in the same manner as in Example A3, except that the undercoat layer formed over the base paper support was served as a first undercoat layer, and that a second undercoat layer containing hollow particles was formed between the base paper support and the first undercoat layer. The air permeance of the undercoat layer of the thermosensitive recording material of Example A5 was 10 mL/min.

(1) Preparation of a Coating Liquid of a Second Undercoat Layer [Liquid I]

The materials of the following compositions were mixed, stirred and dispersed, to thereby prepare a coating liquid of a second undercoat layer [Liquid I].

[Liquid I]

| | |
|---|---|
| Plastic spherical hollow particles (hollow ratio: 90%, solid content: 33%) | 15.15 parts |
| Styrene-butadiene copolymer latex (solid content: 50%) | 20 parts |
| Water | 115 parts |

The coating liquid of the second undercoat layer [Liquid I] was uniformly applied to a surface of a base paper support so as to have a deposition amount of 3.0 g/m$^2$ on dry basis, and then dried, to thereby form the second undercoat layer. Then, the first undercoat layer was formed on the second undercoat layer.

Comparative Example A1

A thermosensitive recording material of Comparative Example A1 was produced in the same manner as in Example A3, except that a thermosensitive coloring layer was formed on a surface of a base paper support without forming an undercoat layer, and that the coating liquid of the first protective layer [Liquid F] without containing the fluorescent whitening agent was uniformly applied so as to have a deposition amount of 2.0 g/m$^2$ on dry basis, and then dried, to thereby form a first protective layer. The air permeance of the base paper support of the thermosensitive recording material of Comparative Example A1 was 500 mL/min.

Comparative Example A2

A thermosensitive recording material of Comparative Example A2 was produced in the same manner as in Example A3, except that the coating liquid of the first protective layer [Liquid F] without containing the fluorescent whitening agent was uniformly applied so as to have a deposition amount of 2.0 g/m$^2$ on dry basis, and then dried, to thereby form a first protective layer. The air permeance of the undercoat layer of the thermosensitive recording material of Comparative Example A2 was 50 mL/min.

Comparative Example A3

A thermosensitive recording material of Comparative Example A3 was produced in the same manner as in Example A3, except that a thermosensitive coloring layer was formed on a base paper support without forming an undercoat layer. The air permeance of the base paper support of the thermosensitive recording material of Comparative Example A3 was 500 mL/min.

Comparative Example A4

A thermosensitive recording material of Comparative Example A4 was produced in the same manner as in Example A3, except that the deposition amount of the undercoat layer was changed from 1.0 g/m$^2$ to 0.4 g/m$^2$. The air permeance of the undercoat layer of the thermosensitive recording material of Comparative Example A4 was 200 mL/min.

Comparative Example A5

A thermosensitive recording material of Comparative Example A5 was produced in the same manner as in Example A5, except that on a second undercoat layer containing hollow particles a thermosensitive coloring layer was formed without forming a first undercoat layer. The air permeance of the undercoat layer of the thermosensitive recording material of Comparative Example A5 was 250 mL/min.

The production conditions of the thermosensitive recording materials in Examples A1 to A5 and Comparative Examples A1 to A5 are shown in Tables A1, A2-1 and A2-2.

TABLE A1

| | Undercoat layer | | | |
|---|---|---|---|---|
| | First undercoat layer (g/m$^2$) | Second undercoat layer (g/m$^2$) | Air permeance (mL/min) | Protective layer Layer structure |
| Ex. A1 | 0.6 | — | 150 | Single layer |
| Ex. A2 | 1.0 | — | 50 | Single layer |
| Ex. A3 | 1.0 | — | 50 | Two layers |
| Ex. A4 | 3.0 | — | 30 | Two layers |
| Ex. A5 | 1.0 | 3.0 | 10 | Two layers |
| Comp. Ex. A1 | — | — | 500* | Two layers (without containing fluorescent whitening agent) |
| Comp. Ex. A2 | 1.0 | — | 50 | Two layers (without containing fluorescent whitening agent) |

TABLE A1-continued

| | Undercoat layer | | | |
|---|---|---|---|---|
| | First undercoat layer (g/m$^2$) | Second undercoat layer (g/m$^2$) | Air permeance (mL/min) | Protective layer Layer structure |
| Comp. Ex. A3 | — | — | 500* | Two layers |
| Comp. Ex. A4 | 0.4 | — | 200 | Two layers |
| Comp. Ex. A5 | 3.0 | — | 250 | Two layers |

*In Table A1, the air permeance of Comparative Examples A1 and A3 was not the air permeance of the undercoat layer, but that of the base paper support.

TABLE A2-1

| | Deposition | Compositions of first protective layer (parts) | | |
|---|---|---|---|---|
| | amount of first protective layer (g/m$^2$) | Fluorescent whitening agent | Water-soluble Resin | Crosslinking agent |
| Ex. A1 | — | — | — | — |
| Ex. A2 | — | — | — | — |
| Ex. A3 | 1.7 | 9.5 | 10 | 2 |
| Ex. A4 | 1.7 | 9.5 | 10 | 2 |
| Ex. A5 | 1.7 | 9.5 | 10 | 2 |
| Comp. Ex. A1 | 2.0 | — | 10 | 2 |
| Comp. Ex. A2 | 2.0 | — | 10 | 2 |
| Comp. Ex. A3 | 1.7 | 9.5 | 10 | 2 |
| Comp. Ex. A4 | 1.7 | 9.5 | 10 | 2 |
| Comp. Ex. A5 | 1.7 | 9.5 | 10 | 2 |

TABLE A2-2

| | Deposition amount of second | Compositions of second protective layer (parts) | | | | |
|---|---|---|---|---|---|---|
| | protective layer (g/m$^2$) | Filler | Water-soluble resin | Cross-linking agent | Lubricant | Fluorescent whitening agent |
| Ex. A1 | 4 | 15 | 10 | 2 | 1 | 6.5 |
| Ex. A2 | 4 | 15 | 10 | 2 | 1 | 6.5 |
| Ex. A3 | 2 | 15 | 10 | 2 | 1 | — |
| Ex. A4 | 2 | 15 | 10 | 2 | 1 | — |
| Ex. A5 | 2 | 15 | 10 | 2 | 1 | — |
| Comp. Ex. A1 | 2 | 15 | 10 | 2 | 1 | — |
| Comp. Ex. A2 | 2 | 15 | 10 | 2 | 1 | — |
| Comp. Ex. A3 | 2 | 15 | 10 | 2 | 1 | — |
| Comp. Ex. A4 | 2 | 15 | 10 | 2 | 1 | — |
| Comp. Ex. A5 | 2 | 15 | 10 | 2 | 1 | — |

<Image Recording>

On each of thermosensitive recording materials of Examples A1 to A5 and Comparative Examples A1 to A5, an image was recorded with the pulse width of 1.2 msec per 1 msec, using a thermosensitive printing experimental apparatus having a thin film head (manufactured by Matsushita Electronic Components, Co., Ltd.) under the following conditions: electrical power of head: 0.45 W/dot; recording time per line: 20 msec/L; and scanning density: 8×385 dot/mm.

On each of the thermosensitive recording materials of Example A3 and Comparative Example A3, an image was recorded using a $CO_2$ laser marker device (LP-400 40W, manufactured by SUNX Co., Ltd.), under the following conditions: scanning velocity: 1,500 mm/s; and setting power: 11.5%.

(Measurement Method and Evaluation Method)

<Method for Measuring Air Permeance>

The air permeance was measured using BENDTSEN TESTER (manufactured by Messmer Instruments Ltd.) in accordance with ISO5636 (Bendtsen method). The results are shown in Table A3.

<Method for Measuring Light Resistance>

The image density of an image recorded part and the image density (color density) of a background part, where no image was recorded, were measured using Macbeth densitometer (DENSIEYE700, manufactured by Gretag Macbeth), before and after Xe light irradiation for 15 hours using a light resistance test device (SUNTEST CPS+, manufactured by Atlas Material Testing Technology LLC). When the image density was measured using the Macbeth densitometer, the image density of the recorded part was measured using a filter for measuring black color, and the image density (color density) of the background part was measured using a filter for measuring yellow color. The results are shown in Table A3.

<Measurement of Background Whiteness>

The background whiteness was measured using Elrepho3000 (manufactured by Datacolor) in accordance with ISO2470. The results are shown in Table A3.

(Method for Measuring and Evaluating Water Resistance)

The water resistance of the thermosensitive recording material was measured and evaluated in such a manner that the thermosensitive recording material was immersed in water for 30 minutes, and then a surface of the thermosensitive recording material was rubbed with a finger moving back and forth 10 times, followed by observing the presence or absence of the peeling of the thermosensitive recording material. The results are shown in Table A3.

From the results of Table A3, each of the thermosensitive recording materials of Comparative Examples A1 and A2 had small value of whiteness, and was inferior in whiteness to the thermosensitive recording materials of Examples A1 to A5.

In the thermosensitive recording materials of Comparative Examples A1 to A5, the density of the background after Xe light irradiation for 15 hours was darker than the density in the initial state before the Xe light irradiation. In the thermosensitive recording materials of Examples A1 to A5, variation in the density of the background between before and after the light irradiation could be suppressed, and the whiteness could be maintained.

Therefore, the thermosensitive recording materials of Examples A1 to A5 were excellent in whiteness and light resistance, and both the whiteness and the light resistance were satisfied.

As a result of image recording performed on the thermosensitive recording material of Example A3 using either a thermal head or a $CO_2$ laser, excellent whiteness and light resistance could be obtained by using either the thermal head or the $CO_2$ laser.

Example B1

(1) Preparation of a Coating Liquid of a Thermosensitive Coloring Layer

[Liquid A]

| | |
|---|---|
| 2-anilino-3-methyl-6-(di-n-butylamino)fluoran | 20 parts |
| 10% itaconic-modified polyvinyl alcohol aqueous solution | 20 parts |
| Water | 60 parts |

TABLE A3

| | Printing method | Whiteness | Initial Image | Initial Background | Light resistance test Image | Light resistance test Background | Peeling |
|---|---|---|---|---|---|---|---|
| Ex. A1 | thermal head | 91 | 1.30 | 0.06 | 1.29 | 0.08 | Absent |
| Ex. A2 | thermal head | 91 | 1.31 | 0.06 | 1.30 | 0.07 | Absent |
| Ex. A3 | thermal head | 91 | 1.31 | 0.06 | 1.30 | 0.07 | Absent |
| | $CO_2$ laser | 91 | 1.33 | 0.06 | 1.32 | 0.07 | Absent |
| Ex. A4 | thermal head | 93 | 1.41 | 0.05 | 1.39 | 0.06 | Absent |
| Ex. A5 | thermal head | 93 | 1.40 | 0.05 | 1.38 | 0.06 | Absent |
| Comp. Ex. A1 | thermal head | 80 | 1.31 | 0.06 | 1.15 | 0.22 | Absent |
| Comp. Ex. A2 | thermal head | 80 | 1.31 | 0.06 | 1.28 | 0.11 | Absent |
| Comp. Ex. A3 | thermal head | 91 | 1.31 | 0.06 | 1.28 | 0.11 | Absent |
| | $CO_2$ laser | 91 | 1.33 | 0.06 | 1.29 | 0.11 | Absent |
| Comp. Ex. A4 | thermal head | 91 | 1.30 | 0.06 | 1.27 | 0.10 | Absent |
| Comp. Ex. A5 | thermal head | 93 | 1.41 | 0.05 | 1.35 | 0.12 | Absent |

[Liquid B]

| | |
|---|---|
| 4-hydroxy-4'-allyloxydiphenylsulfone | 20 parts |
| 10% itaconic-modified polyvinyl alcohol aqueous solution | 20 parts |
| Silica (MIZUKASIL P-527 manufactured by MIZUSAWA INDUSTRIAL CHEMICALS, LTD.) | 10 parts |
| Water | 50 parts |

[Liquid A] and [Liquid B] having the aforementioned compositions respectively, were each dispersed using a sand mill, so that particles contained in each liquid had an average particle diameter of 1.0 μm or less, to thereby prepare a dye dispersion liquid [Liquid A] and a developer dispersion liquid [Liquid B].

Then, [Liquid A] and [Liquid B] were mixed in the ratio of 1/3, so as to adjust the solid content to 25%, followed by stirring, to thereby prepare a coating liquid of a thermosensitive coloring layer [Liquid C].

(2) Preparation of a Coating Liquid of a First Protective Layer

[Liquid D]

| | |
|---|---|
| 10% diacetone-modified polyvinyl alcohol aqueous solution | 100 parts |
| 10% adipic acid dihydrazide aqueous solution | 20 parts |
| Fluorescent whitening agent (stilbene compound, Tinopal UP, solid content: 45%, manufactured by BASF) | 13.3 parts (solid content: 6.0 parts) |
| Water | 100 parts |

The materials of the aforementioned compositions were mixed and stirred, to thereby prepare a coating liquid of a first protective layer [Liquid D].

(3) Preparation of a Coating Liquid of a Second Protective Layer

[Liquid E]

| | |
|---|---|
| 10% diacetone-modified polyvinyl alcohol aqueous solution | 100 parts |
| 10% adipic acid dihydrazide aqueous solution | 20 parts |
| Dispersion liquid of aluminum hydroxide (solid content: 30%) | 50 parts |
| Montanate wax (solid content: 30%) | 3.3 parts |

The materials of the aforementioned compositions were mixed and stirred, to thereby prepare a coating liquid of a second protective layer [Liquid E].

Next, the coating liquid of the thermosensitive coloring layer [Liquid C] was uniformly applied to a surface of a base paper support (woodfree paper having a basis weight of about 60 g/m$^2$) so as to have a deposition amount of 3.0 g/m$^2$ on dry basis, and then dried, to thereby form a thermosensitive coloring layer.

Over the thermosensitive coloring layer, the coating liquid of a first protective layer [Liquid D] was uniformly applied so as to have a deposition amount of 1.5 g/m$^2$ on dry basis, and then dried, and the coating liquid of a second protective layer [Liquid E] was uniformly applied so as to have a deposition amount of 2.0 g/m$^2$ on dry basis, and then dried, to thereby form a first protective layer and a second protective layer in this order over the thermosensitive coloring layer, followed by performing surface treatment by supercalendering, to thereby produce a thermosensitive recording material of Example B1.

Example B2

A thermosensitive recording material of Example B2 was produced in the same manner as in Example B1, except that the amount (solid content) of the fluorescent whitening agent in the coating liquid of a first protective layer [Liquid D] was changed from 6.0 parts to 9.5 parts, and that the coating liquid of the first protective layer [Liquid D] was uniformly applied so as to have a deposition amount of 1.7 g/m$^2$ on dry basis, and then dried, to thereby form a first protective layer.

Example B3

A thermosensitive recording material of Example B3 was produced in the same manner as in Example B1, except that the amount (solid content) of the fluorescent whitening agent in the coating liquid of a first protective layer [Liquid D] was changed from 6.0 parts to 18.0 parts, and that the coating liquid of a first protective layer [Liquid D] was uniformly applied so as to have a deposition amount of 1.7 g/m$^2$ on dry basis, and then dried, to thereby form a first protective layer, followed by uniformly applying the coating liquid of a second protective layer [Liquid E] onto the first protective layer so as to have a deposition amount of 1.0 g/m$^2$ on dry basis, and then dried, to thereby form a second protective layer.

Example B4

A thermosensitive recording material of Example B4 was produced in the same manner as in Example B1, except that the amount (solid content) of the fluorescent whitening agent in the coating liquid of a first protective layer [Liquid D] was changed from 6.0 parts to 20.0 parts, and that the coating liquid of a first protective layer [Liquid D] was uniformly applied so as to have a deposition amount of 2.4 g/m$^2$ on dry basis, and then dried, to thereby form a first protective layer.

Comparative Example B1

A thermosensitive recording material of Comparative Example B1 was produced in the same manner as in Example B1, except that the coating liquid of a first protective layer [Liquid D] without containing the fluorescent whitening agent was uniformly applied so as to have a deposition amount of 2.0 g/m$^2$ on dry basis, and then dried, to thereby form a first protective layer.

Comparative Example B2

A thermosensitive recording material of Comparative Example B2 was produced in the same manner as in Example B1, except that the amount (solid content) of the fluorescent whitening agent in the coating liquid of a first protective layer [Liquid D] was changed from 6.0 parts to 2.5 parts, and that the coating liquid of a first protective layer [Liquid D] was uniformly applied so as to have a deposition amount of 1.2 g/m$^2$ on dry basis, and then dried, to thereby form a first protective layer.

Comparative Example B3

A thermosensitive recording material of Comparative Example B3 was produced in the same manner as in Example B1, except that the amount (solid content) of the fluorescent whitening agent in the coating liquid of a first protective layer [Liquid D] was changed from 6.0 parts to 30.0 parts, and that the coating liquid of a first protective layer [Liquid D] was uniformly applied so as to have a deposition amount of 2.4 g/m$^2$ on dry basis, and then dried, to thereby form a first protective layer.

Comparative Example B4

A thermosensitive recording material of Comparative Example B4 was produced in the same manner as in Example B3, except that the coating liquid of a second protective layer [Liquid E] was uniformly applied onto the first protective layer so as to have a deposition amount of 0.5 g/m$^2$ on dry basis, and then dried, to thereby form a second protective layer.

The production conditions of the thermosensitive recording materials in Examples B1 to B4 and Comparative Examples B1 to B4 are shown in Table B1.

TABLE B1

| | | Ex. B1 | Ex. B2 | Ex. B3 | Ex. B4 | Comp. Ex. B1 | Comp. Ex. B2 | Comp. Ex. B3 | Comp. Ex. B4 |
|---|---|---|---|---|---|---|---|---|---|
| Fluorescent whitening agent | Dry mass (g/m$^2$) | 0.50 | 0.75 | 1.02 | 1.50 | 0.00 | 0.21 | 1.71 | 1.02 |
| | Amount relative to total mount of first protective layer | 33% | 44% | 60% | 63% | 0% | 17% | 71% | 60% |
| | Amount relative to total amount of water-soluble resins and fluorescent whitening agent | 24% | 33% | 52% | 51% | 0% | 12% | 57% | 58% |
| Deposition amount of first protective layer (g/m$^2$) | | 1.5 | 1.7 | 1.7 | 2.4 | 2.0 | 1.2 | 2.4 | 1.7 |
| First protective layer (parts) | Fluorescent whitening agent | 6 | 9.5 | 18 | 20 | 0 | 2.5 | 30 | 18 |
| | Water-soluble resin | 10 | 10 | 10 | 10 | 10 | 10 | 10 | 10 |
| | Crosslinking agent | 2 | 2 | 2 | 2 | 2 | 2 | 2 | 2 |
| Deposition amount of second protective layer (g/m$^2$) | | 2.0 | 2.0 | 1.0 | 2.0 | 2.0 | 2.0 | 2.0 | 0.5 |
| Second protective layer (parts) | Filler | 15 | 15 | 15 | 15 | 15 | 15 | 15 | 15 |
| | Water-soluble resin | 10 | 10 | 10 | 10 | 10 | 10 | 10 | 10 |
| | Crosslinking agent | 2 | 2 | 2 | 2 | 2 | 2 | 2 | 2 |
| | Lubricant | 1 | 1 | 1 | 1 | 1 | 1 | 1 | 1 |

<Image Recording>

On each of thermosensitive recording materials of Examples B1 to B4 and Comparative Examples B1 to B4, an image was recorded with the pulse width of 1.2 msec per 1 msec, using a thermosensitive printing experimental apparatus having a thin film head (manufactured by Matsushita Electronic Components, Co., Ltd.) under the following conditions: electrical power of head: 0.45 W/dot; recording time per line: 20 msec/L; and scanning density: 8×385 dot/mm.

On the thermosensitive recording material of Example B2, an image was recorded using a $CO_2$ laser marker device (LP-400 40W, manufactured by SUNX Co., Ltd.), under the following conditions: scanning velocity: 1,500 mm/s; and setting power: 11.5%.

(Measurement Method and Evaluation Method)

<Method for Measuring Light Resistance>

The image density of an image recorded part and the image density (color density) of a background part, where no image was recorded, were measured using Macbeth densitometer (DENSIEYE700, manufactured by Gretag Macbeth), before and after Xe light irradiation for 15 hours using a light resistance test device (SUNTEST CPS+, manufactured by Atlas Material Testing Technology LLC). When the image density was measured using the Macbeth densitometer, the image density of the recorded part was measured using a filter for measuring black color, and the image density (color density) of the background part was measured using a filter for measuring yellow color. The results are shown in Table B2.

<Measurement of Background Whiteness>

The background whiteness was measured using Elrepho3000 (manufactured by Datacolor) in accordance with ISO2470. The results are shown in Table B2.

(Method for Measuring and Evaluating Water Resistance)

The water resistance of each thermosensitive recording materials of Examples B1 to B4 and Comparative Examples B1 to B4 was measured and evaluated in such a manner that the thermosensitive recording material was immersed in water for 30 minutes, and then a surface of the thermosensitive recording material was rubbed with a finger moving back and forth 10 times, followed by observing the presence or absence of the peeling of the thermosensitive recording material. The results are shown in Table B2.

TABLE B2

| | Printing method | Whiteness | Initial Image | Initial Background | Light resistance test Image | Light resistance test Background | Peeling |
|---|---|---|---|---|---|---|---|
| Ex. B1 | Thermal head | 93 | 1.30 | 0.06 | 1.27 | 0.11 | Absent |
| Ex. B2 | Thermal head | 93 | 1.31 | 0.06 | 1.28 | 0.11 | Absent |
| | $CO_2$ laser | 91 | 1.33 | 0.06 | 1.29 | 0.11 | Absent |
| Ex. B3 | Thermal head | 92 | 1.31 | 0.06 | 1.28 | 0.11 | Absent |
| Ex. B4 | Thermal head | 89 | 1.30 | 0.07 | 1.28 | 0.12 | Absent |
| Comp. Ex. B1 | Thermal head | 80 | 1.31 | 0.06 | 1.15 | 0.22 | Absent |
| Comp. Ex. B2 | Thermal head | 93 | 1.31 | 0.06 | 1.25 | 0.15 | Absent |
| Comp. Ex. B3 | Thermal head | 85 | 1.30 | 0.08 | 1.28 | 0.13 | Present |
| Comp. Ex. B4 | Thermal head | 90 | 1.32 | 0.06 | 1.28 | 0.12 | Present |

From the results of Table B2, each of the thermosensitive recording materials of Comparative Examples B1 and B3 had small value of whiteness, and was inferior in whiteness to the thermosensitive recording materials of Examples B1 to B4.

In the thermosensitive recording materials of Comparative Examples B1 and B2, the density of the background after Xe light irradiation for 15 hours was darker than the density in the initial state before the Xe light irradiation. In the thermosensitive recording materials of Examples B1 to B4, variation in the density of the background between before and after the light irradiation could be suppressed, and the whiteness could be maintained.

In the measurement of the water resistance, on surfaces of the thermosensitive recording materials of Comparative Examples B3 and B4, peeling was observed. The thermosensitive recording materials of Comparative Examples B3 and B4 were inferior in the water resistance to those of Examples B1 to B4 which had no pealing.

Therefore, the thermosensitive recording materials of Examples B1 to B4 were excellent in the whiteness, the light resistance, and the water resistance, and all of the whiteness, the light resistance, and the water resistance were satisfied.

As a result of image recording performed on the thermosensitive recording material of Example B2 using either a thermal head or a $CO_2$ laser, excellent whiteness, light resistance, and water resistance could be obtained by using either the thermal head or the $CO_2$ laser.

Since the thermosensitive recording material of the present invention has excellent whiteness, light resistance, and water resistance, the thermosensitive recording material can be used in various fields: POS field such as perishable foods, boxed meals, and prepared food; copying field such as books and documents; communication field such as facsimile; ticketing field such as ticket vending machines and receipts; and aviation industry such as baggage tags.

What is claimed is:

1. A thermo sensitive recording material comprising:

a support;

an undercoat layer containing at least a water-soluble resin;

a thermosensitive coloring layer containing a leuco dye and a developer; and a protective layer containing a water-soluble resin and a fluorescent whitening agent, wherein the undercoat layer, the thermo sensitive coloring layer, and the protective layer are formed in this order over the support, wherein the undercoat layer has a single layer structure or a multilayer structure, and the protective layer has a multilayer structure, wherein the undercoat layer has an air permeance of 150 mL/min or less, and wherein the protective layer contains a first protective layer containing the water-soluble resin and the fluorescent whitening agent and a second protective layer containing a water-soluble resin but no fluorescent whitening agent, and the first protective layer and the second protective layer are formed in this order over the thermosensitive coloring layer.

2. The thermosensitive recording material according to claim 1, wherein the undercoat layer further contains hollow particles.

3. The thermosensitive recording material according to claim 2, wherein the amount of the water-soluble resin in the undercoat layer is 50% by mass to 80% by mass relative to the total amount of the hollow particles and the water-soluble resin.

4. The thermosensitive recording material according to claim 1, wherein the undercoat layer contains a first undercoat layer containing the water-soluble resin and a second undercoat layer containing hollow particles, and the second undercoat layer and the first undercoat layer are formed in this order over the support toward the thermosensitive coloring layer.

5. The thermosensitive recording material according to claim 1, wherein the fluorescent whitening agent is a stilbene compound.

6. The thermosensitive recording material according to claim 1, wherein the dry mass of the fluorescent whitening agent in the first protective layer is 0.5 $g/m^2$ to 1.5 $g/m^2$, and the amount of the fluorescent whitening agent in the first protective layer is 20% by mass or more relative to the total amount of the first protective layer, and the amount of the fluorescent whitening agent is 55% by mass or less relative to the total amount of the fluorescent whitening agent in the first protective layer and the water-soluble resins in the first protective layer and the second protective layer.

7. The thermosensitive recording material according to claim 1, wherein the first protective layer further contains a crosslinking agent.

8. The thermosensitive recording material according to claim 1, wherein the second protective layer further contains a crosslinking agent, an inorganic filler, and a lubricant.

9. A thermosensitive recording material comprising:

a thermosensitive coloring layer;

a first protective layer containing a fluorescent whitening agent and a water-soluble resin; and a second protective layer containing a water-soluble resin but no fluorescent whitening agent, wherein the first protective layer and the second protective layer are formed in this order over the thermosensitive coloring layer, and wherein the dry mass of the fluorescent whitening agent in the first protective layer is 0.5 $g/m^2$ to 1.5 $g/m^2$, and the amount of the fluorescent whitening agent in the first protective layer is 20% by mass or more relative to the total amount of the first protective layer, and the amount of the fluorescent whitening agent is 55% by mass or less relative to the total amount of the fluorescent whitening agent in the first protective layer and the water-soluble resins in the first protective layer and the second protective layer.

10. The thermosensitive recording material according to claim 9, wherein the fluorescent whitening agent is a stilbene compound.

11. The thermosensitive recording material according to claim 9, wherein the first protective layer further contains a crosslinking agent.

12. The thermosensitive recording material according to claim 9, wherein the second protective layer further contains a crosslinking agent, an inorganic filler, and a lubricant.

13. An image forming method comprising:

recording an image on a thermosensitive recording material using an image recording unit, which is any one of a thermal head and a laser, wherein the thermo sensitive recording material comprises:

a support;

an undercoat layer containing at least a water-soluble resin;

a thermosensitive coloring layer containing a leuco dye and a developer; and a protective layer containing a water-soluble resin and a fluorescent whitening agent, wherein the undercoat layer, the thermo sensitive coloring layer, and the protective layer are formed in this order over the support, wherein the undercoat layer has a single layer structure or a multilayer structure, and the protective layer has a multilayer structure, wherein the undercoat layer has an air permeance of 150 mL/min or less, and wherein the protective layer contains a first protective layer containing the water-soluble resin and the fluorescent whitening agent and a second protective layer containing a water-soluble resin but no fluorescent whitening agent, and the first protective layer and the second protective layer are formed in this order over the thermosensitive coloring layer.

14. The image recording method according to claim 13, wherein the laser is a $CO_2$ laser which emits light having a wavelength of 9.3 μm to 10.6 μm.

* * * * *